US010890096B2

(12) United States Patent
Fujita et al.

(10) Patent No.: US 10,890,096 B2
(45) Date of Patent: Jan. 12, 2021

(54) INTERNAL COMBUSTION ENGINE

(71) Applicant: NICHIAS CORPORATION, Tokyo (JP)

(72) Inventors: Yoshifumi Fujita, Tokyo (JP); Tatsunori Kataoka, Tokyo (JP); Masayuki Nakamura, Ikeda (JP); Takayuki Suzuki, Ikeda (JP); Tomoatsu Oyasu, Ikeda (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 16/485,991

(22) PCT Filed: Feb. 13, 2018

(86) PCT No.: PCT/JP2018/004882

§ 371 (c)(1),
(2) Date: Aug. 14, 2019

(87) PCT Pub. No.: WO2018/151093

PCT Pub. Date: Aug. 23, 2018

(65) Prior Publication Data

US 2020/0063635 A1 Feb. 27, 2020

(30) Foreign Application Priority Data

Feb. 15, 2017 (JP) ..... 2017-025800

(51) Int. Cl.
*F01P 3/02* (2006.01)
*F02F 1/14* (2006.01)

(52) U.S. Cl.
CPC *F01P 3/02* (2013.01); *F02F 1/14* (2013.01); *F01P 2003/021* (2013.01)

(58) Field of Classification Search
CPC ..... F02F 1/14; F02F 1/10; F02F 2001/104; F02F 1/40; F02F 1/166; F01P 2003/021
See application file for complete search history.

(56) References Cited

U.S. PATENT DOCUMENTS

2005/0217615 A1 10/2005 Matsutani et al.
2015/0159540 A1* 6/2015 Misumi ..... F01P 3/02 123/41.44

(Continued)

FOREIGN PATENT DOCUMENTS

EP 3 168 449 5/2017
JP 2002-221079 8/2002

(Continued)

OTHER PUBLICATIONS

International Search Report for PCT/JP2018/004882, dated Apr. 10, 2018, 4 pages.

(Continued)

*Primary Examiner* — Long T Tran
(74) *Attorney, Agent, or Firm* — Nixon & Vanderhye P.C.

(57) ABSTRACT

There is provided a water jacket spacer set in a groove-like coolant passage of a cylinder block of an internal combustion engine including cylinder bores and set in an entire circumferential direction or a part in a circumferential direction of the groove-like coolant passage when viewed in the circumferential direction, wherein a coolant passage opening through which coolant flowing on the rear surface side of the water jacket spacer passes to flow to an inner side of the water jacket spacer is formed on at least one place of upper portions of inter-bore portions, a guide wall for guiding the coolant is formed in a vicinity of the coolant passage opening, such that the coolant flows into the coolant passage opening; and an inclined wall is formed on the rear surface side of bore portions of a position where the coolant is supplied into the groove-like coolant passage, the inclined wall extending with an upward inclination to create a flow of the coolant toward the coolant passage opening.

(Continued)

The present invention can provide a water jacket spacer that has high cooling efficiency of an upper portion of a boundary of the bore walls of the cylinder bores and the vicinity of the boundary.

3 Claims, 19 Drawing Sheets

(56) References Cited

U.S. PATENT DOCUMENTS

| | | | | |
|---|---|---|---|---|
| 2017/0022929 | A1* | 1/2017 | Karita | F02F 1/166 |
| 2017/0298859 | A1* | 10/2017 | Mori | F01P 3/02 |
| 2017/0298860 | A1* | 10/2017 | Mori | F01P 3/02 |
| 2019/0112963 | A1* | 4/2019 | Tabata | F02F 1/10 |

FOREIGN PATENT DOCUMENTS

| | | |
|---|---|---|
| JP | 2006-90194 | 4/2006 |
| JP | 2008-31939 | 2/2008 |
| JP | 2015-108347 | 6/2015 |
| JP | 2017-89563 | 5/2017 |

OTHER PUBLICATIONS

Office Action issued in KR Appln. No. 10-2019-7024663 dated Jul. 23, 2020 (w/ translation).
Search Report issued in EP Appln. No. 18754198.2 dated Nov. 3, 2020.
Office Action issued in JP Appln. No. 2017-025800 dated Nov. 25, 2020 (w/ translation).

* cited by examiner (A)

(B)

(A)

(B)

(A)

(B)

(C)

INTERNAL COMBUSTION ENGINE

This application is the U.S. national phase of International Application No. PCT/JP2018/004882 filed 13 Feb. 2018, which designated the U.S. and claims priority to JP Patent Application No. 2017-025800 filed 15 Feb. 2017, the entire contents of each of which are hereby incorporated by reference.

TECHNICAL FIELD

The present invention relates to a water jacket spacer set in a groove-like coolant passage of a cylinder bore wall of a cylinder block of an internal combustion engine, an internal combustion engine including the water jacket spacer, and an automobile including the internal combustion engine.

BACKGROUND ART

An internal combustion engine has a structure in which an explosion of fuel occurs at a top dead center of a piston in a bore and the piston is pushed down by the explosion, temperature rises on an upper side of a cylinder bore wall and temperature falls on a lower side of the cylinder bore wall. Therefore, a difference occurs in a thermal deformation amount between the upper side and the lower side of the cylinder bore wall. Expansion is large on the upper side and, on the other hand, expansion is small on the lower side.

As a result, frictional resistance between the piston and the cylinder bore wall increases. This causes a decrease in fuel efficiency. Therefore, there is a need to reduce the difference in the thermal deformation amount between the upper side and the lower side of the cylinder bore wall.

Therefore, in order to equalize a wall temperature of the cylinder bore wall, it has been conventionally attempted to set a spacer in the groove-like coolant passage for adjusting a flow of coolant in the groove-like coolant passage and controlling the cooling efficiency on the upper side and the cooling efficiency on the lower side of the cylinder bore wall by the coolant. For example, Patent Literature 1 discloses a heat medium passage partitioning member for cooling an internal combustion engine that is a passage partitioning member disposed in a groove-like heat medium passage for cooling formed in a cylinder block of the internal combustion engine, to thereby partition the groove-like heat medium passage for cooling into a plurality of passages, the passage partitioning member including: a passage dividing member that is formed at height smaller than the depth of the groove-like heat medium passage for cooling and functioning as a wall section that divides the groove-like heat medium passage for cooling into a bore side passage and a counter-bore side passage; and a flexible lip member that is formed from the passage dividing member toward an opening of the groove-like heat medium passage for cooling and formed of a flexible material in a manner in which a distal edge portion extends beyond one inner surface of the groove-like heat medium passage for cooling, whereby, after completion of insertion into the groove-like heat medium passage for cooling, the distal edge portion comes into contact with the inner surface in an intermediate position in a depth direction of the groove-like heat medium passage for cooling with a deflection restoration force of the distal edge portion to separate the bore side passage and the counter-bore side passage.

CITATION LIST

Patent Literature

Patent Literature 1

Japanese Patent Laid-Open No. 2008-31939 (Claims)

SUMMARY OF INVENTION

Technical Problem

In the heat medium passage partitioning member for cooling an internal combustion engine in Patent Literature 1, the wall temperature of the cylinder bore wall can be equalized to some extent. Therefore, it is possible to reduce the difference in the thermal deformation amount between the upper side and the lower side of the cylinder bore wall. However, in recent years, there is a need to further reduce the difference in the thermal deformation amount between the upper side and the lower side of the cylinder bore wall.

In recent years, an internal combustion engine in which an air-fuel ratio which is a ratio between the air and the fuel supplied into the cylinder is larger than the air-fuel ratio of the conventional internal combustion engine is developed. In such an internal combustion engine, the temperature of an upper portion of the cylinder bore wall, specifically, the temperature of the upper portion of a boundary of the bore walls of the cylinder bores and the vicinity of the boundary is higher than the temperature of the conventional internal combustion engine. Therefore, it is demanded to increase the cooling efficiency of the upper portion of the boundary of the bore walls of the cylinder bores and the vicinity of the boundary.

Therefore, an object of the present invention is to provide a water jacket spacer that has high cooling efficiency of an upper portion of a boundary of the bore walls of the cylinder bores and the vicinity of the boundary.

Solution to Problem

The above problems are solved by the present invention described below.

That is, the present invention (1) provides a water jacket spacer set in a groove-like coolant passage of a cylinder block of an internal combustion engine including cylinder bores and set in an entire circumferential direction or a part in a circumferential direction of the groove-like coolant passage when viewed in the circumferential direction, wherein a coolant passage opening through which coolant flowing on a rear surface side of the water jacket spacer passes to flow to an inner side of the water jacket spacer is formed on at least one place of upper portions of inter-bore portions, a guide wall for guiding the coolant is formed in a vicinity of the coolant passage opening, such that the coolant flows into the coolant passage opening; and an inclined wall is formed on the rear surface side of a position where the coolant is supplied into the groove-like coolant passage, the inclined wall extending with an upward inclination to create a flow of the coolant toward the coolant passage opening.

The present invention (2) provides a water jacket spacer set in a groove-like coolant passage of a cylinder block of an internal combustion engine including cylinder bores and set in an entire circumferential direction or a part in a circumferential direction of the groove-like coolant passage when viewed in the circumferential direction, wherein, a coolant passage opening through which coolant flowing on the rear surface side of the water jacket spacer passes to flow to an inner side of the water jacket spacer is formed on at least one place of upper portions of inter-bore portions, and a guide wall for guiding the coolant is formed in a vicinity of the coolant passage opening, such that the coolant flows into the coolant passage opening, and a coolant gathering wall is formed to extend with an upward inclination toward the guide wall.

The present invention (3) provides a water jacket spacer set in a groove-like coolant passage of a cylinder block of an internal combustion engine including cylinder bores and set in an entire circumferential direction of the groove-like coolant passage when viewed in the circumferential direction, wherein, an inclined wall is formed at a position where coolant is supplied into the groove-like coolant passage, a coolant passage opening through which coolant flowing on a rear surface side of the water jacket spacer passes to flow to an inner side of the water jacket spacer is formed on at least one place of upper portions of inter-bore portions set in the groove-like coolant passage in one-side half in which the coolant flows more vigorously, and a guide wall for guiding the coolant is formed in a vicinity of the coolant passage opening such that the coolant flows into the coolant passage opening, and a coolant passage opening through which coolant flowing on a rear surface side of the water jacket spacer passes to flow to the inner side of the water jacket spacer is formed on at least one place of the upper portions of inter-bore portions set in the groove-like coolant passage in one-side half on an opposite side of a side on which the coolant flows more vigorously, a guide wall for guiding the coolant is formed in the vicinity of the coolant passage opening such that the coolant flows into the coolant passage opening, and a coolant gathering wall is formed to extend with an upward inclination toward the guide wall.

The present invention (4) provides an internal combustion engine, wherein the water jacket spacer according to any one of (1) to (3) is set in an entire or a part of a groove-like coolant passage of a cylinder block.

The present invention (5) provides an internal combustion engine, wherein the water jacket spacer according to (1) is set in one one-side half of a groove-like coolant passage of a cylinder block and the water jacket spacer according to (2) is set in the other one-side half of the groove-like coolant passage of the cylinder block.

The present invention (6) provides an automobile including the internal combustion engine according to (4) or (5).

Advantageous Effects of Invention

The present invention can provide a water jacket spacer that has high cooling efficiency of an upper portion of a boundary of the bore walls of the cylinder bores and the vicinity of the boundary.

DESCRIPTION OF EMBODIMENTS

Figure 1:
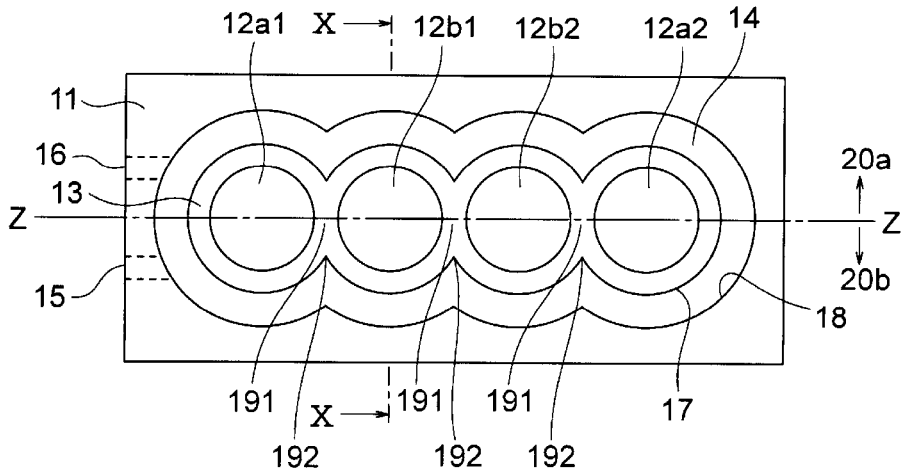
FIG. 1 is a schematic plan view illustrating a form example of a cylinder block in which a water jacket spacer of the present invention is to be set.
Figure 2:
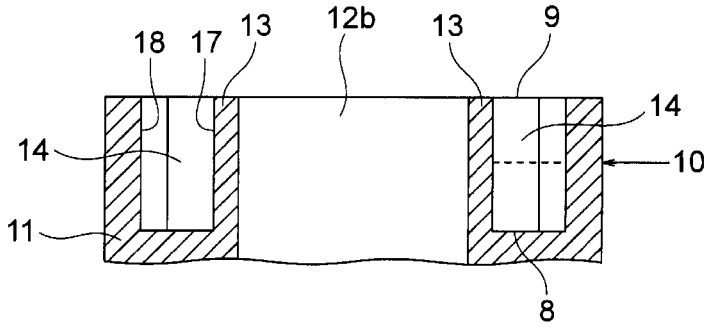
FIG. 2 is a cross-sectional view taken along a line x-x in FIG. 1.
Figure 3:
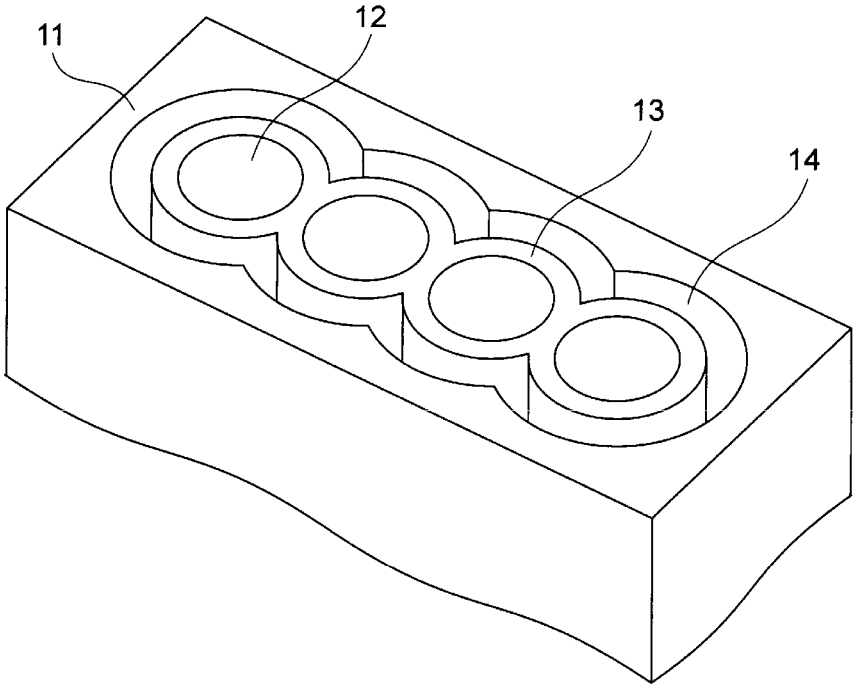
FIG. 3 is a perspective view of the cylinder block illustrated in FIG. 1.
Figure 4:
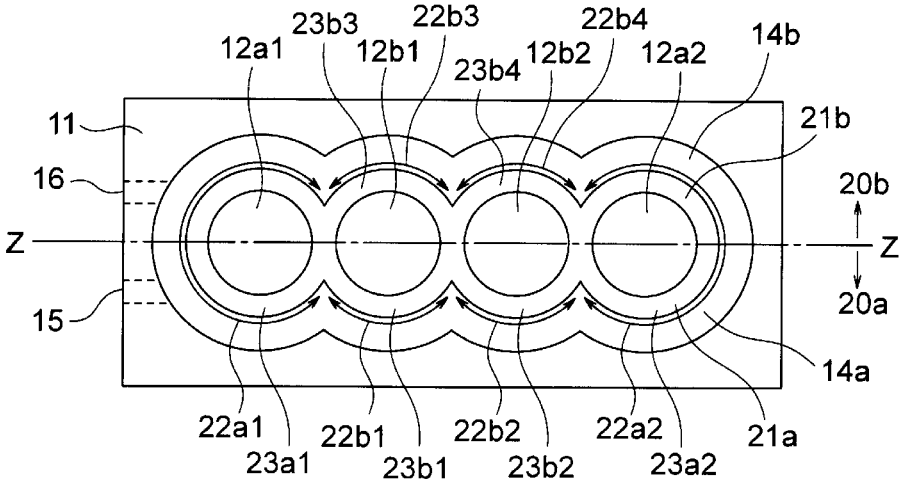
FIG. 4 is a schematic plan view illustrating a form example of the cylinder block in which the water jacket spacer of the present invention is to be set.
Figure 5:
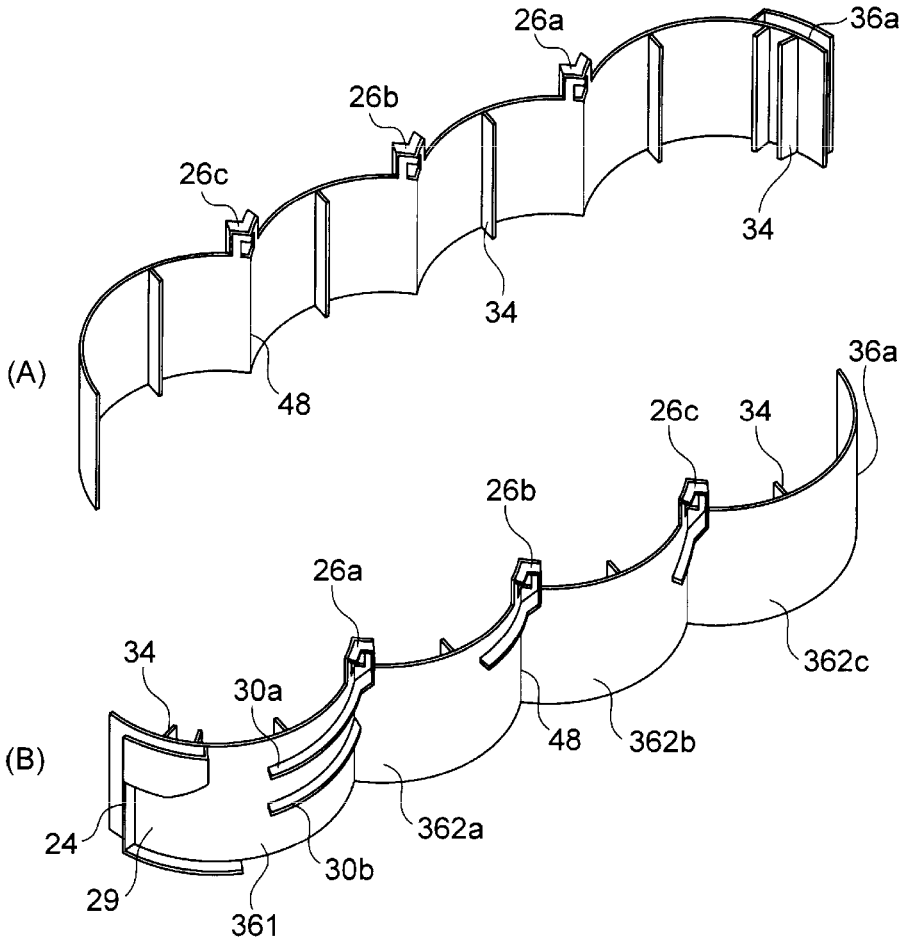
FIG. 5 is a schematic perspective view illustrating a form example of the water jacket spacer of the present invention.
Figure 6:
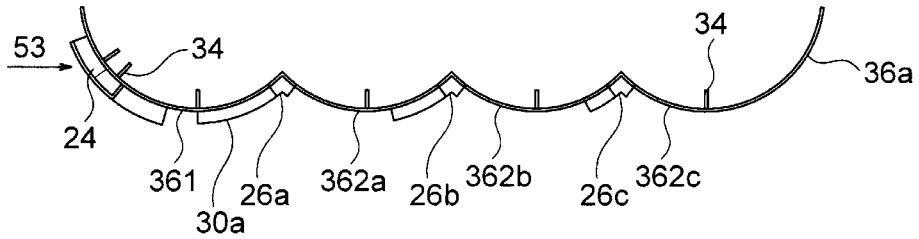
FIG. 6 is a top plan view of a water jacket spacer illustrated in FIG. 5.
Figure 7:
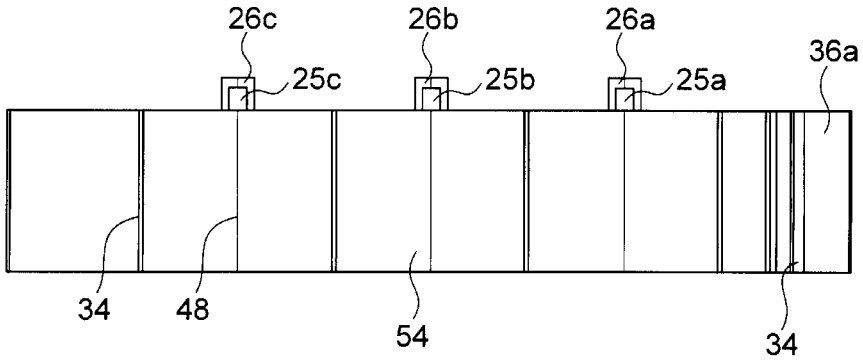
FIG. 7 is a side view of the water jacket spacer illustrated in FIG. 5 as viewed from inside.
Figure 8:
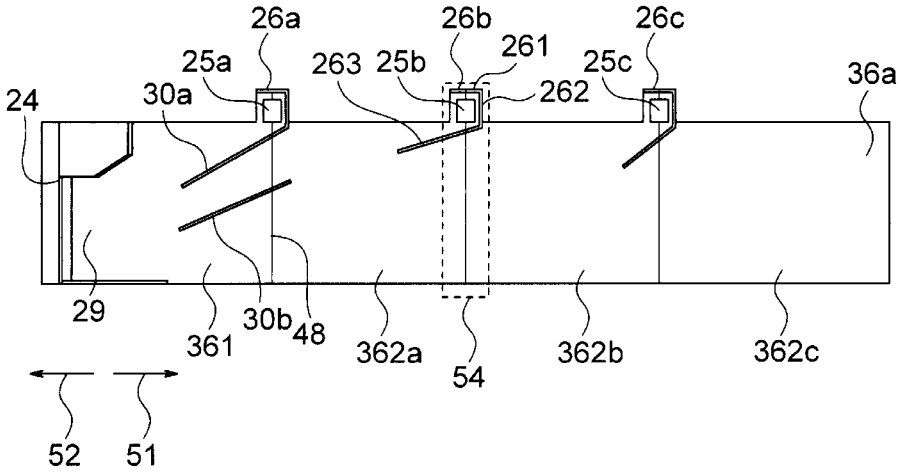
FIG. 8 is a side view of the water jacket spacer illustrated in FIG. 5 as viewed from a rear surface side.
Figure 9:
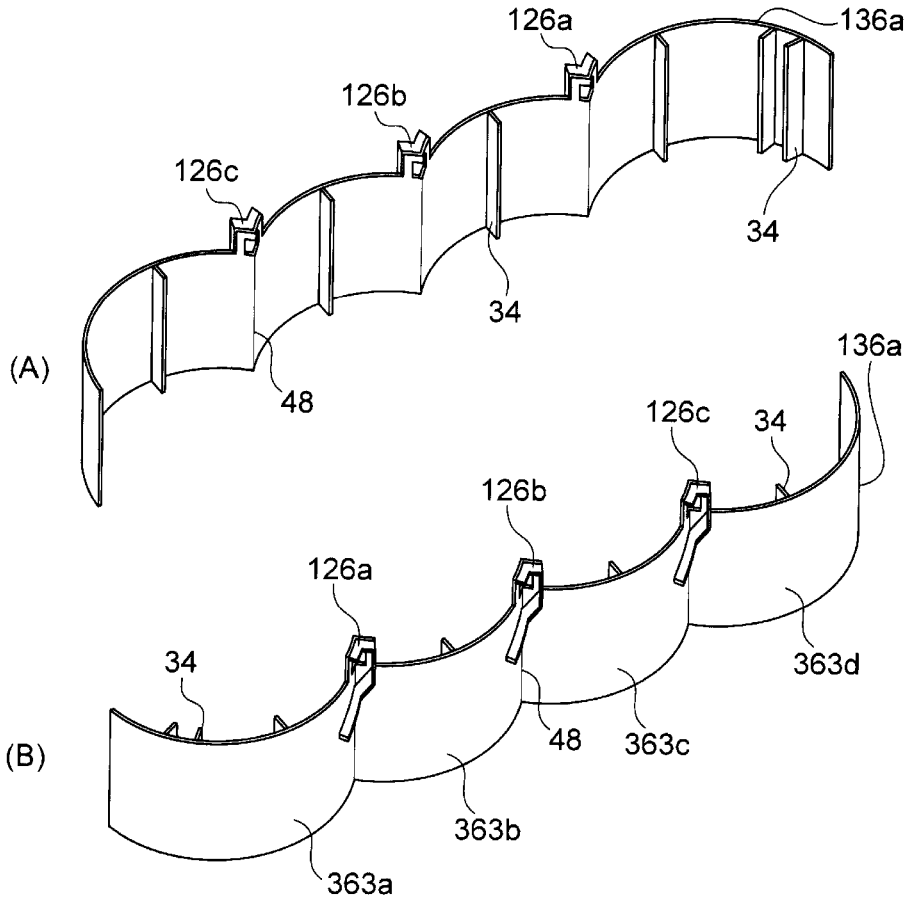
FIG. 9 is a schematic perspective view illustrating a form example of the water jacket spacer of the present invention.
Figure 10:
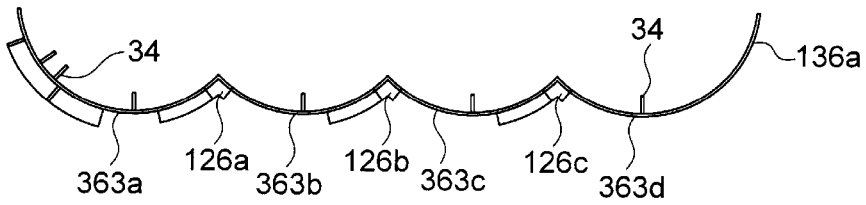
FIG. 10 is a top plan view illustrating the water jacket spacer illustrated in FIG. 9.
Figure 11:
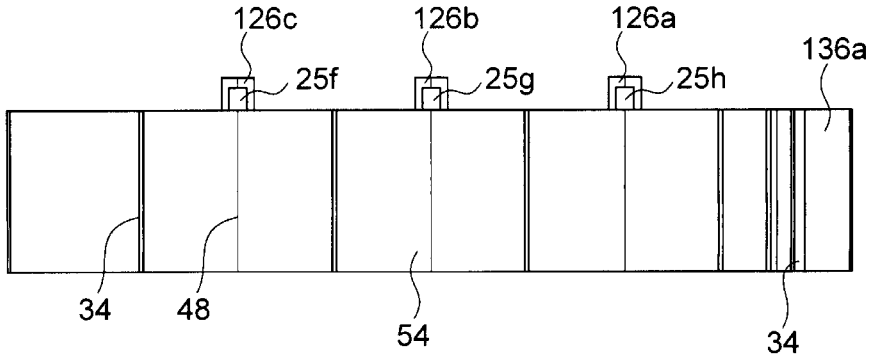
FIG. 11 is a side view illustrating the water jacket spacer illustrated in FIG. 9 as viewed from an inner side.
Figure 12:
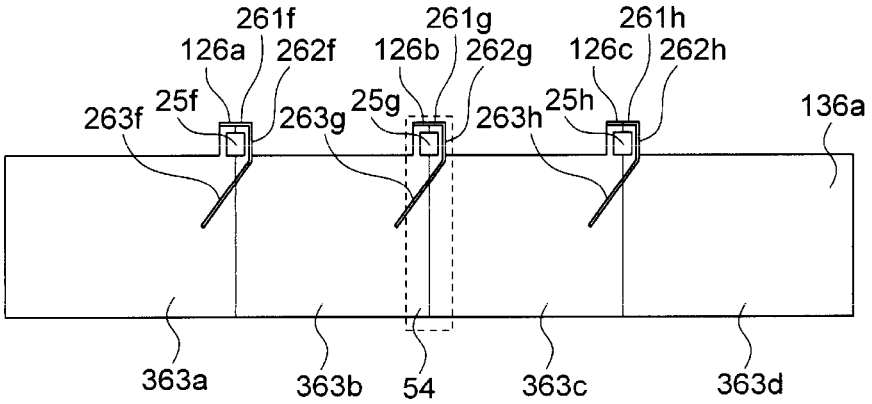
FIG. 12 is a side view illustrating the water jacket spacer illustrated in FIG. 9 as viewed from a rear surface side.

A water jacket spacer of the present invention and an internal combustion engine of the present invention will be described with reference to FIG. 1 to FIG. 12. FIG. 1 to FIG. 4 each illustrate a form example of a cylinder block in which the water jacket spacer of the present invention is set. FIG. 1 and FIG. 4 each are a schematic plan view illustrating the cylinder block in which the water jacket spacer of the present invention is to be set. FIG. 2 is a cross-sectional view taken along a line x-x in FIG. 1. FIG. 3 is a perspective view of the cylinder block illustrated in FIG. 1. FIG. 5 is a schematic perspective view illustrating a form example of the water jacket spacer of the present invention. FIG. 6 is a top view of a water jacket spacer 36*a* illustrated in FIG. 5. FIG. 7 is a side view of the water jacket spacer 36*a* illustrated in FIG. 5 as viewed from inside. FIG. 8 is a side view of the water jacket spacer 36*a* illustrated in FIG. 5 as viewed from a rear surface side. FIG. 9 is a schematic perspective view illustrating a form example of the water jacket spacer of the present invention. FIG. 10 is a top view illustrating the water jacket spacer 136*a* illustrated in FIG. 9. FIG. 11 is a side view illustrating the water jacket spacer 136*a* illustrated in FIG. 9 as viewed from an inner side. FIG. 12 is a side view of the water jacket spacer 136*a* illustrated in FIG. 9 as viewed from a rear surface side.

As illustrated in FIG. 1 to FIG. 3, in an open deck type cylinder block 11 of a vehicle-mounted internal combustion engine in which the water jacket spacer is set, a bore 12 in which a piston moves up and down, and a groove-like coolant passage 14 in which coolant flows are formed. A wall partitioning into the bore 12 and the groove-like coolant passage 14 is a cylinder bore wall 13. In the cylinder block 11, a coolant supply port 15 for supplying the coolant to the groove-like coolant passage 11 and a coolant discharge port 16 for discharging the coolant from the groove-like coolant passage 11 are formed.

In the cylinder block 11, two or more bores 12 are formed side by side in series. Therefore, the bores 12 include end bores 12*a*1 and 12*a*2 adjacent to one bore and intermediate bores 12*b*1 and 12*b*2 sandwiched by two bores (note that, when the number of bores of the cylinder block is two, the bores 12 include only the end bores). Among bores formed side by side in series, the end bores 12*a*1 and 12*a*2 are bores at both ends. The intermediate bores 12*b*1 and 12*b*2 are bores formed between the end bore 12*a*1 at one end and the end bore 12*a*2 at the other end. Each of a wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (inter-bore walls 191) is a portion sandwiched by two bores, to which heat is transmitted from two cylinder bores, resulting in the wall temperature being higher than that of the other walls. On a wall surface 17 on the cylinder bore side of the groove-like coolant passage 14, the temperature is the highest near the inter-bore walls 191. Therefore, the temperature of a boundary 192 of the bore walls of the cylinder bores and the vicinity of the boundary 192 is the highest in the wall surface 17 on the cylinder bore side of the groove-like coolant passage 14.

In the present invention, in a wall surface of the groove-like coolant passage 14, a wall surface on the cylinder bore 13 side is referred to as a wall surface 17 on the cylinder bore side of the groove-like coolant passage. In the wall surface of the groove-like coolant passage 14, a wall surface on an opposite side of the wall surface 17 on the cylinder bore side of the groove-like coolant passage is referred to as a wall surface 18.

In the present invention, a one-side half indicates a half on one side when the cylinder block is vertically divided into two in a direction in which the cylinder bores are disposed side by side. Therefore, in the present invention, bore walls in one-side half among the bore walls of all the cylinder bores indicate bore walls in the half on the one side when all the cylinder bore walls are vertically divided into two in the direction in which the cylinder bores are disposed side by side. For example, in FIG. 4, the direction in which the cylinder bores are disposed side by side is a Z-Z direction. Each of bore walls in one-side halves when the cylinder bore wall is divided into two by this Z-Z line is a bore wall in a one-side half among the bore walls of all the cylinder bores. That is, in FIG. 4, the bore wall in a one-side half further on the 20*a* side than the Z-Z line is a bore wall 21*a* in one one-side half among the bore walls of all the cylinder bores. The bore wall in further on the 20*b* side than the Z-Z line is a bore wall 21*b* in the other one-side half among the bore walls of all the cylinder bores. One side among all the cylinder bore walls indicates either the bore wall 21*a* in one-side half or the bore wall 21*b* in the one-side half. A part of one side indicates a part of the bore wall 21*a* in the one-side half or a part of the bore wall 21*b* in the one-side half. In the present invention, the groove-like coolant passage in a one-side half of the groove-like coolant passage indicates a half groove-like coolant passage on one side when the entire groove-like coolant passage is vertically divided into two in a direction in which the cylinder bores are disposed side by side. In FIG. 4, the groove-like coolant passage on the 20*a* side than the Z-Z line is a groove-like coolant passage 14*a* in one one-side half of the entire groove-like coolant passage. The groove-like coolant passage on the 20*b* side than the Z-Z line is a groove-like coolant passage 14*b* in the other one-side half of the entire groove-like coolant passage.

In the present invention, the bore walls of the cylinder bores indicate bore wall portions corresponding to respective individual cylinder bores. In FIG. 4, a range indicated by a double-headed arrow 22*a*1 is a bore wall 23*a*1 of the cylinder bore 12*a*1, a range indicated by a double-headed arrow 22*b*1 is a bore wall 23*b*1 of the cylinder bore 12*b*1, a range indicated by a double-headed arrow 22*b*2 is a bore wall 23*b*2 of the cylinder bore 12*b*2, a range indicated by a double-headed arrow 22*a*2 is a bore wall 23*a*2 of the cylinder bore 12*a*2, a range indicated by a double-headed arrow 22*b*3 is a bore wall 23*b*3 of the cylinder bore 12*b*1, and a range indicated by a double-headed arrow 22*b*4 is a bore wall 23*b*4 of the cylinder bore 12*b*2. That is, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2, the bore wall 23*b*3 of the cylinder bore 12*b*1, and the bore wall 23*b*4 of the cylinder bore 12*b*2 are the bore walls of the cylinder bores, respectively.

The water jacket spacer 36*a* illustrated in FIG. 5 is a form example of a water jacket spacer of a first form of the present invention. The water jacket spacer 36*a* is a water jacket spacer set in the groove-like coolant passage 14*a* in one one-side half (on the 20*a* side) in FIG. 4. The water jacket spacer 36*a* is a form example of a water jacket spacer in which not only an inclined wall but also a coolant contact surface and a coolant flow suppressing wall are formed on a bore portion of the water jacket spacer at a position to which the coolant is supplied.

The water jacket spacer 36*a* is formed in a shape of continuous four arcs when viewed from above. The shape of the water jacket spacer 36*a* is a shape conforming to a one-side half of the groove-like coolant passage 14. The water jacket spacer 36*a* is an injection molded product made of a synthetic resin. That is, the water jacket spacer 36*a* is made of a synthetic resin.

The water jacket spacer 36*a* is formed in a shape of continuous four arcs when viewed from above. Each part of the water jacket spacer 36*a* on the cylinder bore side is a bore portion. That is, each part formed in an arcuate shape in the water jacket spacer 36*a* is a bore portion of the water jacket spacer. In the water jacket spacer 36*a*, a bore portion 361 on an end bore 12*a*1 side at one end, a bore portion 362*a* on an intermediate bore 12*b*1 side, a bore portion 362*b* on the intermediate bore 12*b*2 side, and a bore portion 362*c* on an end bore 12*a*2 side at the other end, each of which is formed in an arcuate shape when viewed from above, are continuously connected in this order.

The bore portions of the water jacket spacer 36*a* include the bore portion 361 in which the inclined wall 30 is formed, and the bore portion 362 in which the inclined wall 30 is not formed. Note that the coolant 53 is supplied to the water jacket spacer 36*a* in a direction indicated by an arrow illustrated in FIG. 6.

The bore portion 361 is a bore portion at a position where the coolant is supplied into the groove-like coolant passage. In the cylinder block 11 illustrated in FIG. 4, the coolant supply port 15 is formed at a position of the groove-like coolant passage on the cylinder bore 12*a*1 side and the one-side half 20*a* side. Therefore, the bore portion 361 on the cylinder bore 12*a*1 side is a bore portion at a position where the coolant is supplied into the groove-like coolant passage.

A coolant contact surface 29, a coolant flow suppressing wall 24, and an inclined wall 30 are formed on a rear surface side of the bore portion 361. The coolant contact surface 29 is a surface on which the coolant supplied from outside of the cylinder block firstly strikes. The coolant flow suppressing wall 24 is a wall which is provided such that the coolant which has struck on the coolant contact surface 29 flows toward the inclined wall 30 without flowing in the opposite direction 52 of the coolant flow direction. Therefore, the coolant flow suppressing wall 24 is formed to surround a portion of the coolant contact surface 29 on the opposite side of a side toward which the coolant flows. That is, the wall is formed at the upper side, the lateral side, and the lower side of the portion of the coolant contact surface 29 on the opposite side of the side toward which the coolant flows. The inclined wall 30 is an inclined wall for creating the flow of the coolant from the coolant contact surface 29 toward a coolant passage opening 25 such that the coolant flowing in the coolant flow direction 51 flows toward the coolant passage opening 25 after striking on the coolant contact surface 29. Therefore, the inclined wall 30 extends with an upward inclination from the vicinity of the coolant contact surface 29 as a start point.

The coolant passage opening 25 is formed on the upper portion of a water jacket spacer inter-bore portion 54. The coolant passage opening 25 is a passage opening through which the coolant flowing on the rear surface side of the water jacket spacer 36*a* passes to flow to the inner side of the water jacket spacer 36*a*. A guide wall 26 is formed in the vicinity of the coolant passage opening 25. The guide wall 26 is a wall for guiding the coolant such that the coolant flowing from the coolant contact surface 29 toward the coolant passage opening 25 flows into the coolant passage opening 25. The guide wall 26 includes an upper wall 261 formed on the upper side of the coolant passage opening 25, and a side wall 262 formed on the lateral side in the coolant flow direction, and therefore the flow of the coolant flowing from the obliquely lower side of the coolant passage opening 25 is blocked by the upper wall 261 and the side wall 262, so that the coolant flows into the coolant passage opening 25. A coolant gathering wall 263 which is inclined upwardly toward the lower end of the side wall 262 is connected to the lower end of the side wall 262 of the guide wall 26. The coolant gathering wall 263 plays a role of gathering the coolant flowing slightly below the coolant passage opening 25 at the coolant passage opening 25. Note that in the form example illustrated in FIG. 5, a coolant gathering wall of a guide wall 26*a* is connected with an inclined wall 30*a*.

In the water jacket spacer 36*a*, a portion connecting the bore portions adjacent to each other is a boundary 48 of the bore portions of the water jacket spacer. A portion of the boundary 48 of the bore portions and the vicinity of the boundary 48 in the water jacket spacer 36*a* is a portion facing a wall surface corresponding to the lateral side of the inter-bore wall 191 in the wall surface on the groove-like coolant passage side. In the present invention, the portion of the boundary of the bore portions of the water jacket spacer and the vicinity of the boundary in the supporting section, that is, the portion facing the wall surface corresponding to the lateral side of the inter-bore wall in the wall surface on the groove-like coolant passage is referred to as a water jacket spacer inter-bore portion.

A vertical rib 34 is formed on the inner surface of the water jacket spacer 36*a* for each of the bore portions of the water jacket spacer. Note that, in the present invention, the vertical rib may or need not be formed on the inner surface of the water jacket spacer. The formation of the vertical rib, the formation position of the vertical rib, the number of the vertical ribs are appropriately selected as needed.

The water jacket spacer 136*a* illustrated in FIG. 9 is a form example of a water jacket spacer of a second form of the present invention. The water jacket spacer 136*a* is a water jacket spacer set in the groove-like coolant passage 14*b* in one one-side half (on the 20*b* side) in FIG. 4. The water jacket spacer 136*a* adopts a form in which all of the bore portions of the water jacket spacer have no inclined wall formed thereon.

The water jacket spacer 136*a* is formed in a shape of continuous four arcs when viewed from above. The shape of the water jacket spacer 136*a* is a shape conforming to a one-side half 14*b* of the groove-like coolant passage 14. The water jacket spacer 136*a* is an injection molded product made of a synthetic resin. That is, the water jacket spacer 136*a* is made of a synthetic resin.

The water jacket spacer 136*a* is formed in a shape of continuous four arcs when viewed from above. In the water jacket spacer 136*a*, a bore portion 363*d* on an end bore 12*a*1 side at one end, a bore portion 363*c* on an intermediate bore 12*b*1 side, a bore portion 363*b* on the intermediate bore 12*b*2 side, and a bore portion 363*a* on an end bore 12*a*2 side at the other end, each of which is formed in an arcuate shape when viewed from above, are continuously connected in this order.

The water jacket spacer 136*a* is set not in the groove-like coolant passage in the one-side half on the side where the coolant which has flowed into the groove-like coolant passage vigorously flows but in the groove-like coolant passage in the other one-side half (the one-side half 14*b* in the form example in FIG. 4) on the side where the coolant gently flows after flowing the groove-like coolant passage in the one-side half. Therefore, none of the bore portions 363 in the water jacket spacer 136*a* has inclined wall formed thereon.

The coolant passage opening 25 is formed on the upper portion of an inter-bore portion 54 in the water jacket spacer 136*a*. The coolant passage opening 25 is a passage opening through which the coolant flowing on the rear surface side of the water jacket spacer 136*a* passes to flow to the inner side of the water jacket spacer 136*a*. A guide wall 126 is formed in the vicinity of the coolant passage opening 25. The guide wall 126 is a wall for guiding the coolant such that the coolant flowing on the rear surface side of the water jacket spacer 136*a* toward the coolant passage opening 25 flows into the coolant passage opening 25. The guide wall 126 includes an upper wall 261 formed on the upper side of the coolant passage opening 25, and a side wall 262 formed on the lateral side in the coolant flow direction, and therefore the flow of the coolant flowing from the obliquely lower side of the coolant passage opening 25 is blocked by the upper wall 261 and the side wall 262, so that the coolant flows into the coolant passage opening 25. A coolant gathering wall 263 which is inclined upwardly toward the lower end of the side wall 262 is connected to the lower end of the side wall 262 of the guide wall 26. The coolant gathering wall 263 plays a role of gathering the coolant flowing below the coolant passage opening 25 at the coolant passage opening 25.

A vertical rib 34 is formed on the inner surface of the water jacket spacer 136*a* for each of the bore portions of the water jacket spacer.

Figure 13:
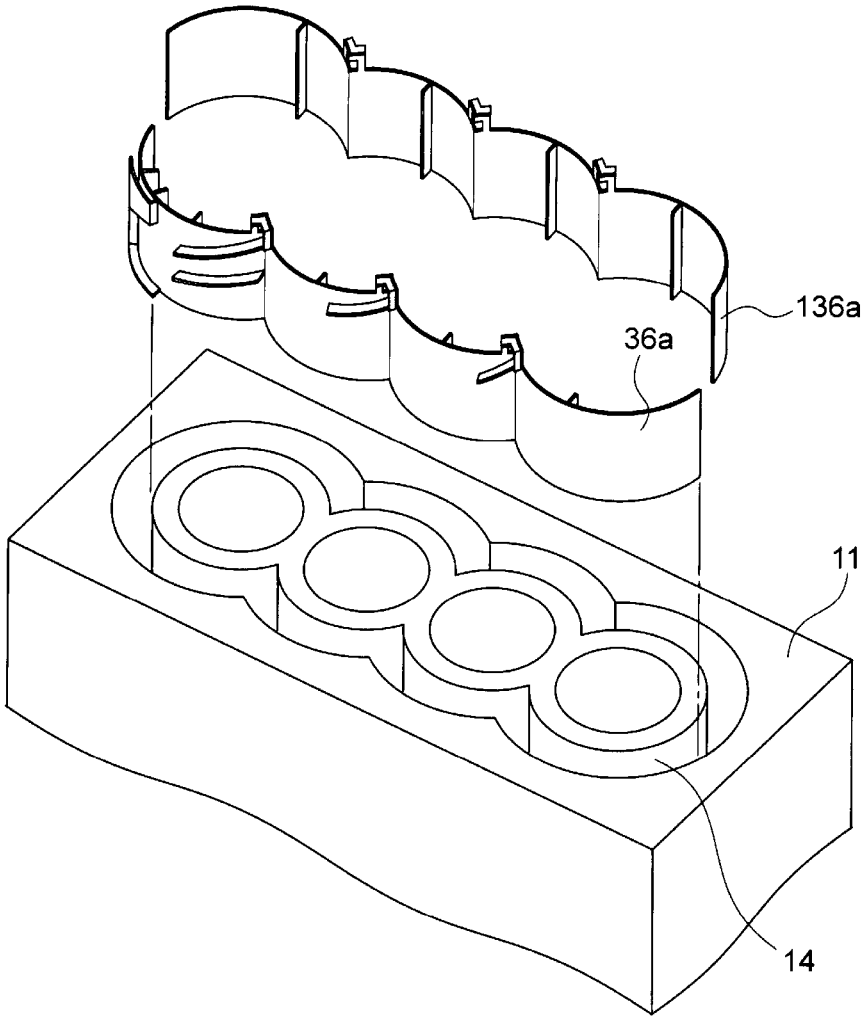
FIG. 13 is a schematic view illustrating a state in which the water jacket spacers 36*a* and 136*a* are to be set in the cylinder block 11 illustrated in FIG. 1.
Figure 14:
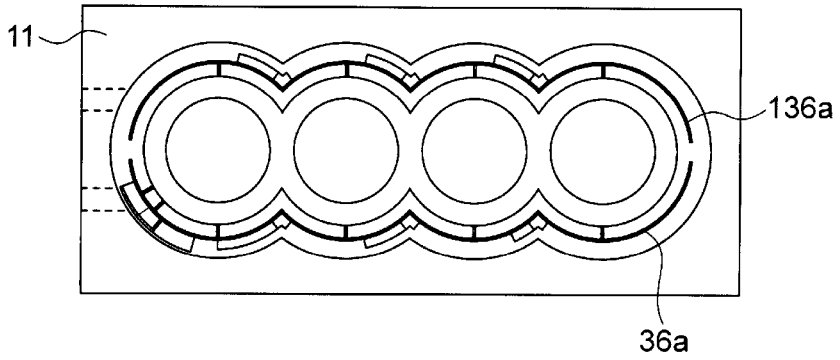
FIG. 14 is a schematic view illustrating a state in which the water jacket spacers 36*a* and 136*a* are set in the cylinder block 11 illustrated in FIG. 1.

The water jacket spacer 36*a* and the water jacket spacer 136*a* are set in, for example, the groove-like coolant passage 14 of the cylinder block 11 illustrated in FIG. 1. As illustrated in FIG. 13, the water jacket spacer 36*a* and the water jacket spacer 136*a* are inserted into the groove-like coolant passage 14 of the cylinder block 11. As illustrated in FIG. 14, the water jacket spacer 36*a* and the water jacket spacer 136*a* are set in the groove-like coolant passage 14. In this way, the water jacket spacer 36*a* is set on the groove-like coolant passage 14*a* in one one-side half, and the water jacket spacer 136*a* is set on the groove-like coolant passage 14*b* in the other one-side half.

Figure 15:
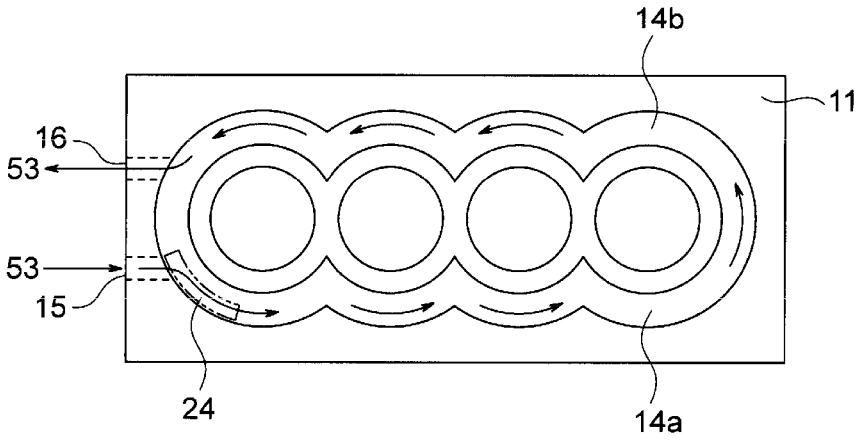
FIG. 15 is a view illustrating a flow direction of the coolant supplied to a groove coolant passage.

The flow of the coolant when the coolant is supplied into the groove-like coolant passage 14 in a state in which the water jacket spacer 136*a* for the cylinder bore wall are set in the groove-like coolant passage 14 of the cylinder block 11 illustrated in FIG. 1 will be described with reference to FIG. 15 to FIG. 19. FIG. 15 is a view illustrating a flow direction of coolant 53 flowing in the groove-like coolant passage when the coolant 53 is supplied from the coolant supply port 15 of the cylinder block 11 and is discharged from the coolant discharge port 16 of the cylinder block 11, and is a top view of the cylinder block 11. Note that, in FIG. 15, for the convenience of description, only a contour of the coolant flow suppressing wall 24 of the water jacket spacer 36*a* is indicated by a two-dot chain line, and the other portions of the water jacket spacer 36*a* and the water jacket spacer 136*a* are omitted. As illustrated in FIG. 15, the coolant 53 supplied from the coolant supply port 15 firstly flows from an end on the coolant supply port 15 side of the groove-like coolant passage 14*a* in one one-side half toward an end on the opposite side of the end on the coolant supply port 15 side in the groove-like coolant passage 14*a* due to the presence of the coolant flow suppressing wall 24 in the vicinity of the coolant supply port 15. Subsequently, when reaching the end on the opposite side of the end on the coolant supply port 15 side in the groove-like coolant passage 14*a* in the one one-side half, the coolant 53 turns to the groove-like coolant passage 14*b* in the other one-side half, flows toward the coolant discharge port 16 in the groove-like coolant passage 14*b* in the other one-side half, and then is discharged from the coolant discharge port 16.

Figure 16:
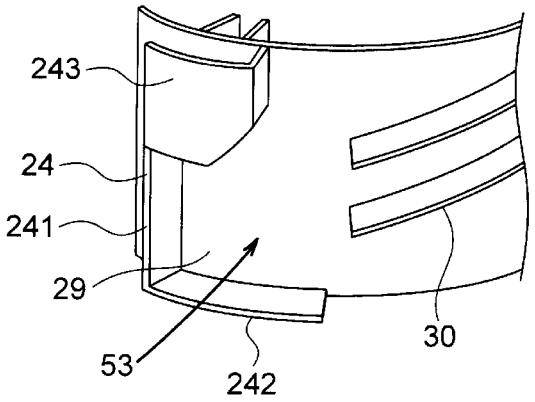
FIG. 16 is a view illustrating a flow direction of the coolant supplied to a groove coolant passage.
Figure 17:
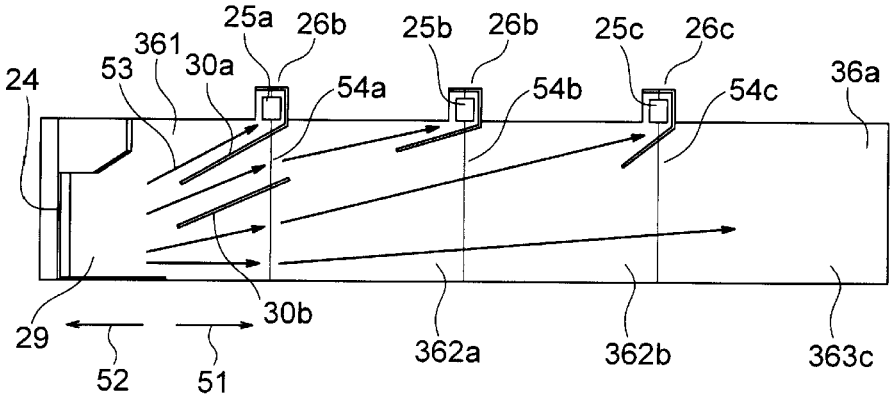
FIG. 17 is a view illustrating a flow direction of the coolant supplied to a groove coolant passage.
Figure 18:
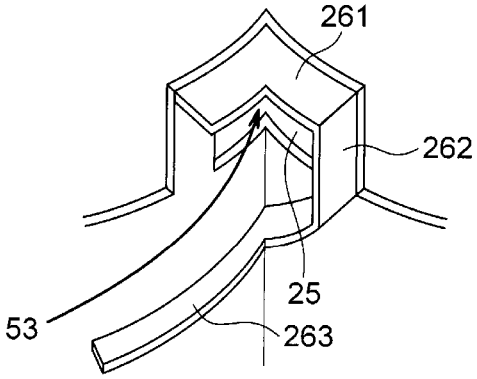
FIG. 18 is a view illustrating a flow direction of the coolant supplied to a groove coolant passage.

As illustrated in FIG. 16, the coolant 53 supplied from the coolant supply port 15 firstly strikes on the coolant contact surface 29 on the rear surface side of the bore portion 361 of a water jacket spacer 36*a*. The coolant flow suppressing wall 24 is formed on the opposite side of the coolant flow direction of the coolant contact surface 29 to surround an approximately half portion on the opposite side of the coolant flow direction in the coolant contact surface 29. Therefore, the coolant 53 that has struck on the coolant contact surface 29 flows toward the inclined wall 30 in the coolant flow direction 51 without flowing in the opposite direction 52 of the coolant flow direction. Subsequently, as illustrated in FIG. 17, the inclined wall 30 extending with an upward inclination from the vicinity of the coolant contact surface 29 is formed at a more advanced position in the coolant flow direction on the coolant contact surface 29. Therefore, the coolant 53 flowing toward the inclined wall 30 is redirected by this inclined wall 30, and flows toward the coolant passage opening 25 formed on the upper portion of the water jacket spacer inter-bore portion 54. That is, the flow of the coolant toward the coolant passage opening 25 is created by the inclined wall 30, the coolant passage opening 25 being formed on the upper portion of the water jacket spacer inter-bore portion 54. In the water jacket spacer 36*a* in the form example illustrated in FIG. 17, coolant passage openings 25*a*, 25*b*, and 25*c* are formed on three upper portions of the water jacket spacer inter-bore portions 54, respectively. Two inclined walls 30*a* and 30*b* create the coolant flow toward the coolant passage opening 25*a*, the coolant flow toward the coolant passage opening 25*b*, and the coolant flow toward the coolant passage opening 25*c*. Subsequently, as illustrated in FIG. 18, the guide wall 26 for guiding the coolant 53 that has flowed toward the coolant passage opening 25 to flow into the coolant passage opening 25 is formed in the vicinity of the coolant passage opening 25. Therefore, the coolant 53 that has flowed toward the coolant passage opening 25 flows into the coolant passage opening 25 by the guide wall 26, and flows from the outside to the inside of the water jacket spacer 36*a*. Since the coolant passage opening 25 is formed on the upper portion of the water jacket spacer inter-bore portion 54, there is the upper portion of the boundary 192 of the bore walls of the cylinder bores and the vicinity of the boundary 192 beyond the coolant passage opening 25. The coolant 53 flowing from the coolant contact surface 29 toward the coolant passage opening 25 has a low temperature, and the temperature of the upper portion of the boundary 192 of the bore walls of the cylinder bores and the vicinity of the boundary 192 is the highest in the wall surface on the cylinder bore side of the groove-like coolant passage. Accordingly, in the water jacket spacer 36*a*, the coolant 53 that has flowed from the coolant contact surface 29 toward the coolant passage opening 25, that is, the coolant 53 having a low temperature can strike on the highest temperature portion in the wall surface on the cylinder bore side of the groove-like coolant passage, whereby the cooling efficiency can be increased.

Figure 19:
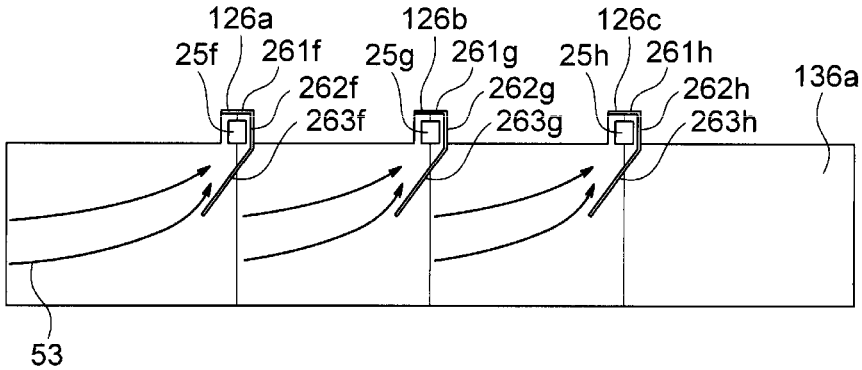
FIG. 19 is a view illustrating a flow direction of the coolant supplied to a groove coolant passage.

The coolant that has flowed into the groove-like coolant passage gently flows in the groove-like coolant passage (the groove-like coolant passage 14*b* in a one-side half in FIG. 15) in the one-side half on the opposite side of a side where the coolant vigorously flows. Usually, a passage hole of the coolant called a drill path is provided in the cylinder block, the passage hole passing from the upper portion of the boundary of the bore walls of the cylinder bores to the inter-bore wall of the cylinder head. Therefore, the gentle flow of the coolant toward the upper portion of the boundary of bore walls of the cylinder bores, that is, the coolant passage openings 25*f*, 25*g*, and 25*h* formed on the upper portion of the inter-bore portion 54 is created in the groove-like coolant passage on the rear surface side of the water jacket spacer 136*a*. As illustrated in FIG. 19, the coolant 53 flowing below the coolant passage openings 25*g* is gathered, toward the coolant passage openings 25*f*, 25*g*, and 25*h*, together with the coolant 53 flowing toward the coolant passage openings 25*f*, 25*g*, and 25*h* by the coolant gathering walls 263*f*, 263*g*, and 263*h*, and flows into the coolant passage openings 25*f*, 25*g*, and 25*h* by guide walls 126*a*, 126*b*, and 126*c*. Accordingly, in the water jacket spacer 136*a*, the coolant flowing on the rear surface side can be gathered to flow into an inlet of the drill path, whereby the cooling efficiency can be increased.

Figure 20:
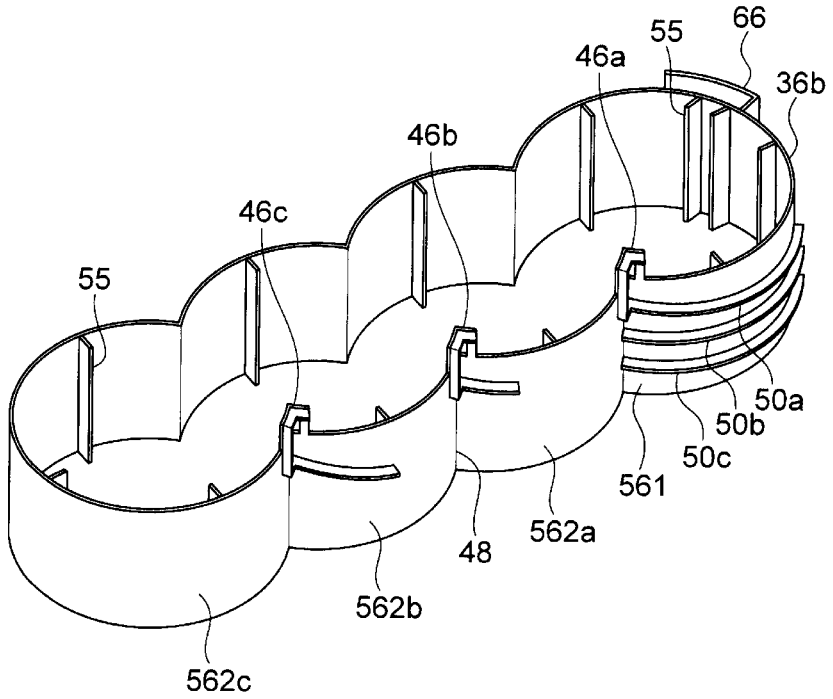
FIG. 20 is a schematic perspective view illustrating another form example of a water jacket spacer of the present invention.
Figure 21:
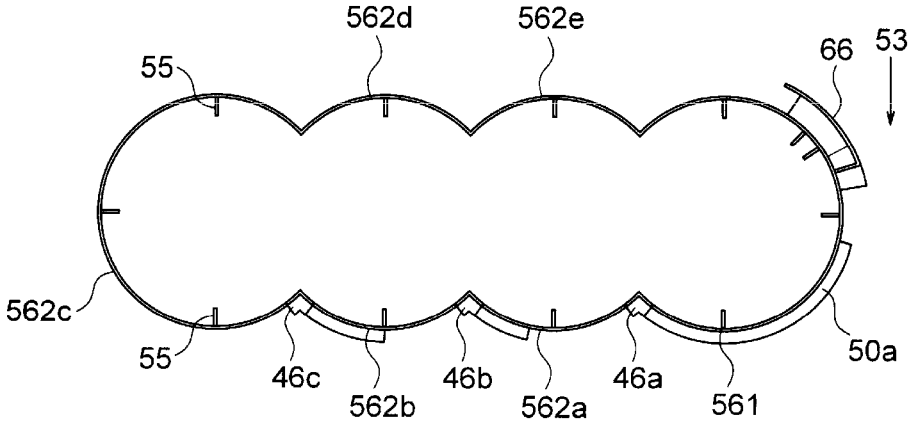
FIG. 21 is a plan view illustrating the water jacket spacer illustrated in FIG. 20 as viewed from an upper side.
Figure 22:
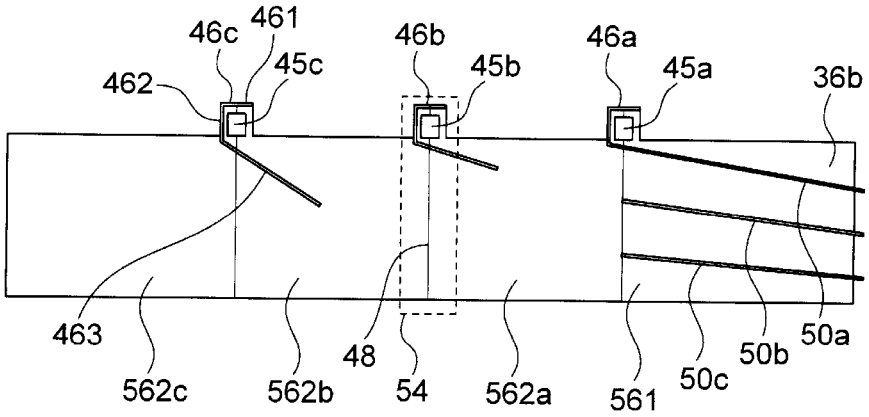
FIG. 22 is a side view illustrating a side on which a coolant passage opening of the water jacket spacer illustrated in FIG. 20 is formed, as viewed from a rear surface side.
Figure 23:
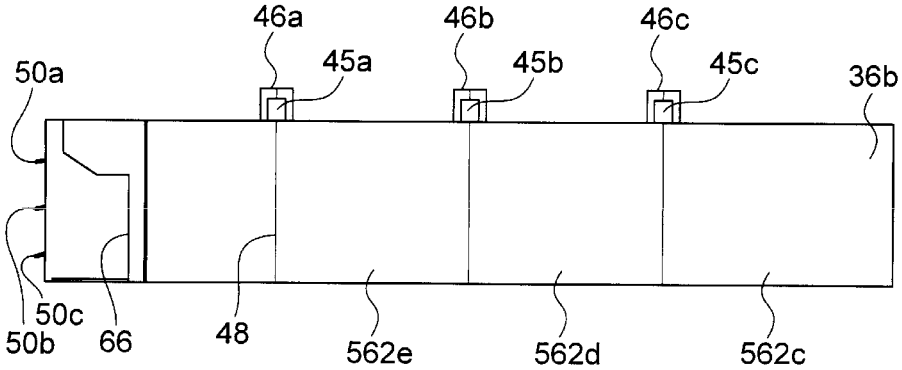
FIG. 23 is a side view illustrating a side on which a coolant passage opening of the water jacket spacer illustrated in FIG. 20 is not formed, as viewed from a rear surface side.
Figure 24:
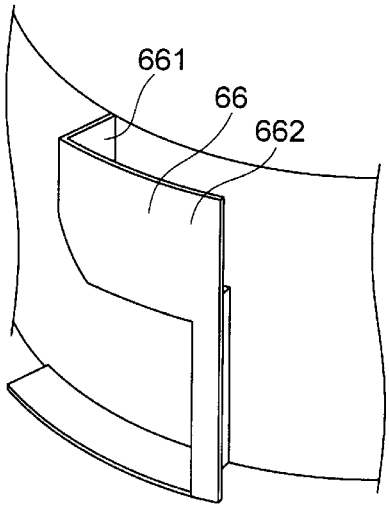
FIG. 24 is an enlarged view of a coolant flow changing member 66 of the water jacket spacer illustrated in FIG. 20.
Figure 24:
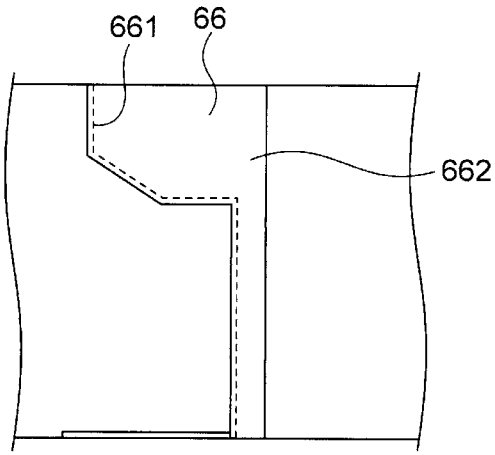

Another form example of the water jacket spacer of the present invention will be described. FIG. 20 is a schematic perspective view illustrating another form example of the water jacket spacer of the present invention. FIG. 21 is a top view of a water jacket spacer 36*b* illustrated in FIG. 20. FIG. 22 is a side view of the water jacket spacer 36*b* illustrated in FIG. 20 as viewed from a side on which a coolant passage opening is formed. FIG. 23 is a side view of the water jacket spacer 36*b* illustrated in FIG. 20 as viewed from a side on which a coolant passage opening is not formed.

The water jacket spacer 36*b* illustrated in FIG. 20 is another form example of a water jacket spacer of the present invention. The water jacket spacer 36*b* is a water jacket spacer which is set in the entire circumferential direction of the groove-like coolant passage 14 in FIG. 28. The water jacket spacer 36*b* is a form example of a water jacket spacer at a position to which the coolant is supplied, in which the inclined wall is formed on the bore portion of the water jacket spacer but the coolant contact surface and the coolant flow suppressing wall are not formed.

The water jacket spacer 36*b* is formed into a shape surrounding the circumference of the cylinder bore wall when viewed from above, and the shape of the water jacket spacer 36*b* is a shape conforming to the entire circumference of the groove-like coolant passage 14. The water jacket spacer 36*b* is an injection molded product made of a synthetic resin. That is, the water jacket spacer 36*b* is made of a synthetic resin.

The water jacket spacer 36*b* is formed in a shape of continuous six arcs when viewed from above. Each part of the water jacket spacer 36*b* on the cylinder bore side is a bore portion. That is, each part formed in an arcuate shape in the water jacket spacer 36*b* is a bore portion of the water jacket spacer. In the water jacket spacer 36*b*, a bore portion 561 on an end bore side at one end, a bore portion 562*a* on an intermediate bore side, a bore portion 562*b* on the intermediate bore side, a bore portion 562*c* on an end bore side at the other end, a bore portion 562*d* on an intermediate bore side, and a bore portion 562*e* on an intermediate bore side, each of which is formed in an arcuate shape when viewed from above, are continuously connected in this order.

The bore portions of the water jacket spacer include the bore portion 561 in which an inclined wall 50 is formed, and the bore portion 562 in which the inclined wall 50 is not formed.

The bore portion 561 is a bore portion at a position where the coolant is supplied into the groove-like coolant passage. In a cylinder block 31 illustrated in FIG. 28, the bore portion 561 is at a position where a coolant supply port 44 is formed.

The inclined wall 50 is formed on a rear surface side of the bore portion 561. The inclined wall 50 is an inclined wall for creating the flow of the coolant from the vicinity of the position into which the coolant flows toward a coolant passage opening 45 such that the coolant supplied from the coolant supply port 35 flows toward the coolant passage opening 45. Therefore, the inclined wall 50 extends with an upward inclination from, as a start point, the vicinity of the position between the water jacket spacer and the wall surface on the opposite side of the wall surface on the cylinder bore side of the groove-like coolant passage, into which much of the coolant supplied from the coolant supply port flows.

The coolant passage opening 45 is formed on the upper portion of the water jacket spacer inter-bore portion 54. The coolant passage opening 45 is a passage opening through which the coolant flowing on the rear surface side of the water jacket spacer 36*b* passes to flow to the inner side of the water jacket spacer 36*b*. A guide wall 46 is formed in the vicinity of the coolant passage opening 45. The guide wall 46 is a wall for guiding the coolant such that the coolant flowing from the position into which the coolant flows toward the coolant passage opening 25 flows into the coolant passage opening 45. The guide wall 46 includes an upper wall 461 formed on the upper side of the coolant passage opening 45, and a side wall 462 formed on the lateral side in the coolant flow direction, and therefore the flow of the coolant flowing from the obliquely lower side of the coolant passage opening 45 is blocked by the upper wall 461 and the side wall 462, so that the coolant flows into the coolant passage opening 45. A coolant gathering wall 463 which is inclined upwardly toward the lower end of the side wall 462 is connected to the lower end of the side wall 462 of the guide wall 46. The coolant gathering wall 463 plays a role of gathering the coolant flowing slightly below the coolant passage opening 45 at the coolant passage opening 45. Note that in the form example illustrated in FIG. 20, a coolant gathering wall of a guide wall 46*a* is connected with an inclined wall 50*a*.

A vertical rib 55 is formed on the inner surface of the water jacket spacer 36*b* for each of the bore portions of the water jacket spacer. A coolant flow changing member 66 is formed in the bore portion 561 among the bore portions in the water jacket spacer 36*b*. The coolant flow changing member 66 is a member for stopping the flow of the coolant which has flowed in the groove-like coolant passage, to change the flow of the coolant to the upward direction. Note that the coolant whose flow direction has been changed to the upward direction flows into the coolant passage in the cylinder head that is mounted on the cylinder block.

Figure 28:
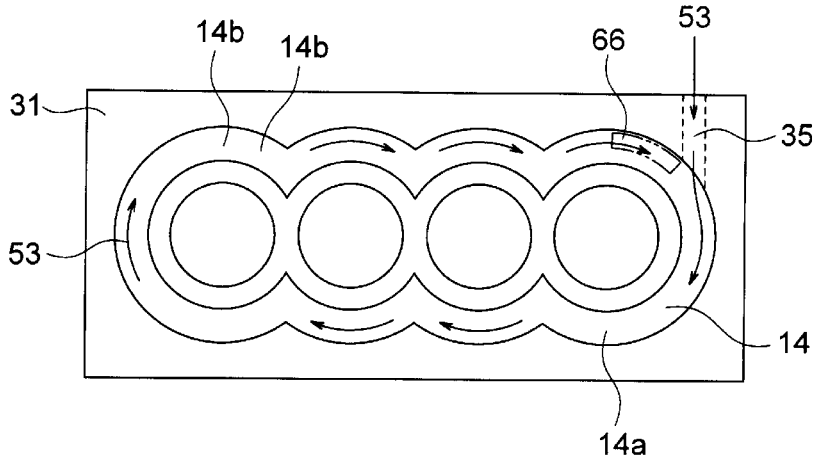
FIG. 28 is a view illustrating a flow direction of the coolant supplied to a groove coolant passage.

The water jacket spacer 36*b* is set in, for example, the groove-like coolant passage 14 of the cylinder block 31 illustrated in FIG. 28.

The flow of the coolant when the coolant is supplied into the groove-like coolant passage 14 in a state in which the water jacket spacer 36*b* is set in the groove-like coolant passage 14 of the cylinder block 31 illustrated in FIG. 28 will be described with reference to FIG. 25 to FIG. 28. FIG. 28 is a view illustrating a flow direction of coolant 53 flowing in the groove-like coolant passage when the coolant 53 is supplied from the coolant supply port 28 of the cylinder block 31 and is discharged to the coolant passage in the cylinder head that is mounted on the cylinder block 31 when viewed from above of the cylinder block 31. Note that, in FIG. 28, for the convenience of description, only a contour of the coolant flow changing member 66 of the water jacket spacer 36*b* is indicated by a two-dot chain line, and the other portions of the water jacket spacer 36*b* are omitted. As illustrated in FIG. 28, the cylinder block 31 has a structure in which the coolant supplied from the coolant supply port 31 flows through an area between the water jacket spacer and the wall surface on the opposite side of the wall surface on the cylinder block side of the groove-like coolant passage without strongly striking on the rear surface of the water jacket spacer that is set in the groove-like coolant passage 14, and flows to the groove-like coolant passage 14*a* in one one-side half. The coolant that has flowed to one end side of the groove-like coolant passage 14*a* in one one-side half firstly flows from one end side to an end on the opposite side of the one end side of the groove-like coolant passage in one one-side half. Subsequently, when reaching the end on the opposite side of the end on a side on which the coolant flows into the groove-like coolant passage 14*a* in one one-side half, the coolant turns to the groove-like coolant passage 14*b* in the other one-side half, and flows in the groove-like coolant passage 14*b* in the other one-side half toward the coolant supply port 35. Since the coolant flow changing member 66 is provided in front of the coolant supply port 35 in the flow direction of the coolant in the groove-like coolant passage 14*b* in the other one-side half, the flow of the coolant is changed to the upward direction at the position of the coolant flow changing member 66, whereby the coolant is discharged to the coolant passage in the cylinder head.

Figure 25:
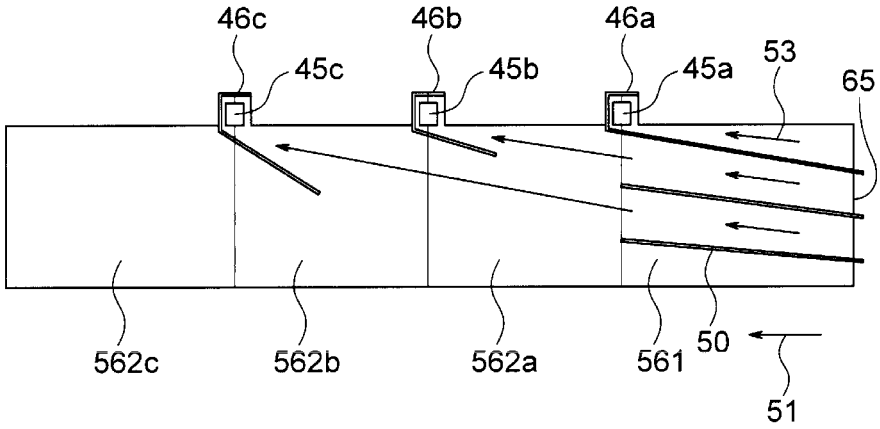
FIG. 25 is a view illustrating a flow direction of the coolant supplied to a groove coolant passage.

The coolant 53 supplied from the coolant supply port 35 of the cylinder block 31 illustrated in FIG. 28 firstly flows through an area between the bore portion 561 of the water jacket spacer 36*b* and the wall surface on the opposite side of the wall surface on the cylinder bore side of the groove-like coolant passage, and flows into the groove-like coolant passage 14*a* in one one-side half. Subsequently, the water jacket spacer 36*b* bore portion 561 is provided on the side on which the coolant flows into the groove-like coolant passage 14*a* in one one-side half, and as illustrated in FIG. 25, on the rear surface side of the bore portion 561, the inclined wall 50 that is inclined upwardly is formed from, as a start point, a portion 65 positioned in the vicinity of the inlet of the groove-like coolant passage 14*a* in one one-side half. Therefore, the flow of the coolant 53 is changed due to this inclined wall 50, and the coolant 53 flows toward the coolant passage opening 45 formed on the upper portion of the water jacket spacer inter-bore portion 54. That is, the flow of the coolant toward the coolant passage opening 45 is created by the inclined wall 50, the coolant passage opening 45 being formed on the upper portion of the inter-bore portion 54. In the water jacket spacer 36*b* in the form example illustrated in FIG. 20, the coolant passage openings 45*a*, 45*b*, and 45*c* are formed at three upper portions of the inter-bore portions 54, respectively. Three inclined walls 50*a*, 50*b*, and 50*c* create the coolant flow toward the coolant passage opening 45*a*, the coolant flow toward the coolant passage opening 45*b*, and the coolant flow toward the coolant passage opening 45*c*. Subsequently, the guide wall 46 for guiding the coolant 53 that has flowed toward the coolant passage opening 45 to flow into the coolant passage opening 45 is formed in the vicinity of the coolant passage opening 45. Therefore, the coolant 53 that has flowed toward the coolant passage opening 45 flows into the coolant passage opening 45 by the guide wall 46, and flows from the outside to the inside of the water jacket spacer 36*b*. Since the coolant passage opening 45 is formed on the upper portion of the water jacket spacer inter-bore portion 54, there is the upper portion of the boundary 192 of the bore walls of the cylinder bores and the vicinity of the boundary 192 beyond the coolant passage opening 45. The coolant 53 flowing to the rear surface side of the bore portion 561 of the groove-like coolant passage 14*a* in one one-side half has a low temperature, and the temperature of the upper portion of the boundary 192 of the bore walls of the cylinder bores and the vicinity of the boundary 192 is the highest in the wall surface on the cylinder bore side of the groove-like coolant passage. Accordingly, in the water jacket spacer 36*b*, the coolant 53 that has flowed to the rear surface side of the bore portion 561 of the groove-like coolant passage 14*a* in one one-side half, that is, the coolant having a low temperature can strike on the highest temperature portion in the wall surface on the cylinder bore side of the groove-like coolant passage, whereby the cooling efficiency can be increased.

Figure 26:
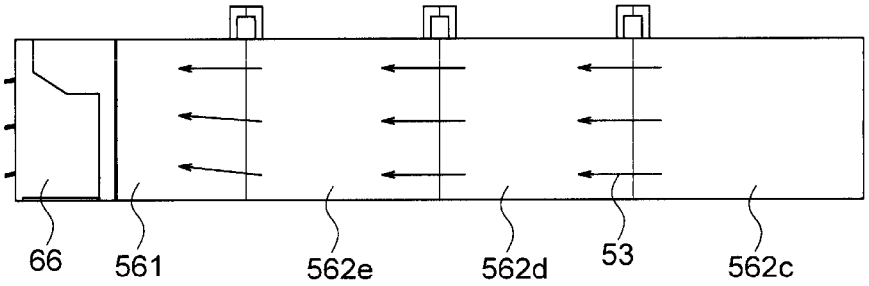
FIG. 26 is a view illustrating a flow direction of the coolant supplied to a groove coolant passage.
Figure 27:
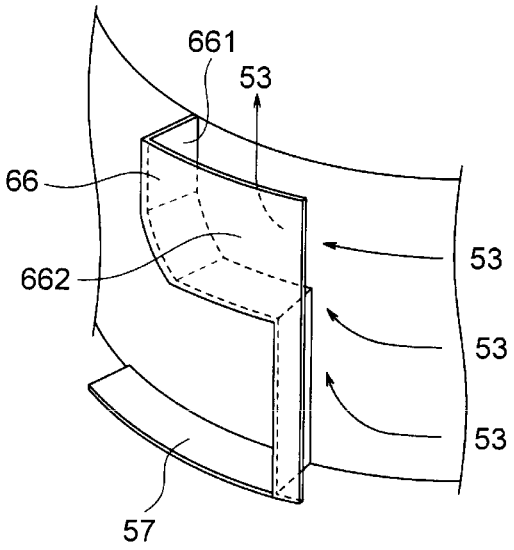
FIG. 27 is a view illustrating a flow direction of the coolant supplied to a groove coolant passage.
Figure 27:
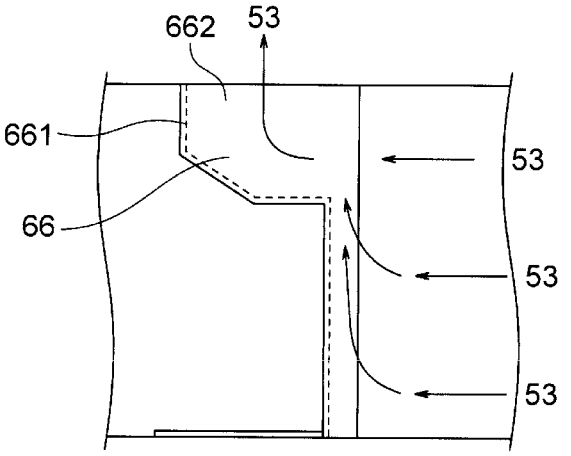

The coolant that has not flowed into the coolant passage opening 45 in the coolant flowing on the rear surface side of the bore portion 561, the bore portion 562*a*, and the bore portion 562*b* in the groove-like coolant passage 14*a* in one one-side half flows on the rear surface side of the bore portion 562*c*, and on the groove-like coolant passage 14*b* in other one-side half. Then, as illustrated in FIG. 26, the coolant flows on the rear surface side of the bore portion 562*d*, and on the rear surface side of the bore portion 562*e*, and reaches a position at which the coolant flow changing member 66 is formed. As illustrated in FIG. 27, the coolant 53 that has reached the coolant flow changing member 66 strikes on a coolant flow changing wall 661, the flow direction of the coolant 53 is changed to the upward direction, and the coolant 53 flows to the coolant passage in the cylinder head that is mounted on the cylinder block 31. Note that an enclosure wall 662 provided on the lateral side of the coolant flow changing wall 661 and projecting in front of the coolant flow changing wall 661 in the flow direction is formed in the coolant flow changing member 66, so that the coolant 53 flows toward the coolant flow changing wall 661 and is less likely to pass through a gap between the coolant flow changing wall 661 and the wall surface on the opposite side of the wall surface on the cylinder bore side of the groove-like coolant passage.

The coolant flow changing wall 661 of the coolant flow changing member 66 plays a role of preventing the coolant supplied from the coolant supply port 35 to the groove-like coolant passage 14 from flowing toward the bore portion 562*e*.

A water jacket spacer of a first form of the present invention is a water jacket spacer set in a groove-like coolant passage of a cylinder block of an internal combustion engine including cylinder bores and set in an entire circumferential direction or a part in a circumferential direction of the groove-like coolant passage when viewed in the circumferential direction, in which a coolant passage opening through which coolant flowing on the rear surface side of the water jacket spacer passes to flow to an inner side of the water jacket spacer is formed on at least one place of upper portions of inter-bore portions, a guide wall for guiding the coolant is formed in a vicinity of the coolant passage opening, such that the coolant flows into the coolant passage opening; and an inclined wall is formed on the rear surface side of a position where the coolant is supplied into the groove-like coolant passage, the inclined wall extending with an upward inclination to create a flow of the coolant toward the coolant passage opening.

The water jacket spacer of the first form of the present invention is set in the groove-like coolant passage of the cylinder block of the internal combustion engine. The cylinder block in which the water jacket spacer of the present invention is set is a cylinder block of an open deck type in which two or more cylinder bores are formed side by side in series. When the cylinder block is a cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed side by side in series, bores at both ends are referred to as end bores and a bore sandwiched by other cylinder bores on both sides is referred to as intermediate bore.

A position where the water jacket spacer of the first form of the present invention is set is a groove-like coolant passage. In many internal combustion engines, a position equivalent to a middle and lower part of the groove-like coolant passage of the cylinder bore is a position where the speed of a piston increases. Therefore, it is desirable to set the spacer in the middle and lower part of the groove-like coolant passage. In FIG. 2, a position 10 near the middle between a top part 9 and a bottom part 8 of the groove-like coolant passage 14 is indicated by a dotted line. A portion of the groove-like coolant passage 14 in the lower side of the position 10 near the middle is referred to as a middle and lower part of the groove-like coolant passage. Note that the middle and lower part of the groove-like coolant passage does not mean a portion below a position right in the middle between the top part and the bottom part of the groove-like coolant passage and means a portion below the vicinity of the intermediate position between the top part and the bottom part. Depending on the structure of the internal combustion engine, the position where the speed of the piston increases is a position corresponding to a lower part of the groove-like coolant passage of the cylinder bore. In that case, it is desirable to set the spacer in the lower part of the groove-like coolant passage. Therefore, it is appropriately selected to which position from the bottom part of the groove-like coolant passage the water jacket spacer of the present invention is set, that is, in which position in the up-down direction of the groove-like coolant passage the position of the upper end of the water jacket spacer is set.

The water jacket spacer of the first form of the present invention is set in the entire circumferential direction or a part in a circumferential direction of the groove-like coolant passage when viewed in the circumferential direction. Examples of the water jacket spacer of the first form of the present invention include a water jacket spacer set in a one-side half of the entire groove-like coolant passage as in a form example illustrated in FIG. 5, and a water jacket spacer set in all of the entire groove-like coolant passage. Examples of the water jacket spacer of the first form of the present invention include a water jacket spacer set in one one-side half and the other one-side half following the one one-side half of the entire groove-like coolant passage. Note that, in the present invention, a one-side half means a one-side half in the circumferential direction of the groove-like coolant passage.

The water jacket spacer of the first form of the present invention is formed in a shape of a plurality of continuous arcs when viewed from above, and has a shape conforming to the groove-like coolant passage in which the water jacket spacer of the present invention is set. Each part of the water jacket spacer of the present invention on the cylinder bore side is a bore portion of the water jacket spacer. That is, each of arcuate portions of the water jacket spacer of the first form of the present invention is a bore portion.

The water jacket spacer of the first form of the present invention is an injection molded product made of a synthetic resin, for example. That is, the water jacket spacer of the first form of the present invention is made of a synthetic resin, for example. The synthetic resin of which the water jacket spacer of the first form of the present invention is made is not limited to a particular synthetic resin if the synthetic resin has heat resistance and LLC (long life coolant) resistance enough to allow use for the water jacket spacer set in the groove-like coolant passage of the cylinder block of the internal combustion engine.

The bore portions of the water jacket spacer include a bore portion in which the inclined wall is formed on the rear surface side thereof and a bore portion in which the inclined wall is not formed on the rear surface side thereof.

The bore portion in which the inclined wall is formed on the rear surface side thereof is a bore portion at a position where the coolant is supplied into the groove-like coolant passage. Examples of the water jacket spacer of a first form of the present invention include a thermal insulator in a form in which not only an inclined wall but also a coolant contact surface and a coolant flow suppressing wall are formed in the bore portion of the water jacket spacer at the position to which the coolant is supplied (hereinafter, also referred to as a water jacket spacer of a first (A) form of the present invention), and a thermal insulator in a form in which an inclined wall is formed on the bore portion of the water jacket spacer at a position to which the coolant is supplied but the coolant contact surface and the coolant flow suppressing wall are not formed thereon (hereinafter, also referred to as a water jacket spacer of a first (B) form of the present invention).

The water jacket spacer of the first (A) form of the present invention is a water jacket spacer set in a cylinder block, in which the inclination of the rear surface of the water jacket spacer with respect to the direction in which the coolant flows into the groove-like coolant passage is relatively large at a position where the coolant that has flowed into the groove-like coolant passage from the coolant supply port strikes on the water jacket spacer. In the cylinder block in which the water jacket spacer of the first (A) form of the present invention, the coolant flowing into the groove-like coolant passage from the coolant supply port strongly strikes on the coolant contact surface on the rear surface side of the water jacket spacer, and then flows in the opposite direction of the direction in the coolant flow suppressing wall is formed, due to the presence of the coolant flow suppressing wall.

In the water jacket spacer of the first (A) form of the present invention, the coolant contact surface is formed at a position on which the coolant supplied from the coolant supply port firstly strikes, in the bore portion in which the inclined wall is formed on the rear surface side thereof, and the coolant flow suppressing wall is formed to surround a portion of the coolant contact surface on the opposite side of the side toward which the coolant flows.

The coolant contact surface related to the water jacket spacer of the first (A) form of the present invention is a surface on which the coolant supplied from outside of the cylinder block firstly strikes. In the form example illustrated in FIG. 1, the coolant supply port 15 is provided at a position illustrated in FIG. 1. However, the position of the coolant supply port varies depending on the type of internal combustion engine. Therefore, a position at which the coolant contact surface is formed is selected as appropriate according to the formation position of the coolant supply port of the cylinder block in which the water jacket spacer of the present invention is set.

Figure 30:
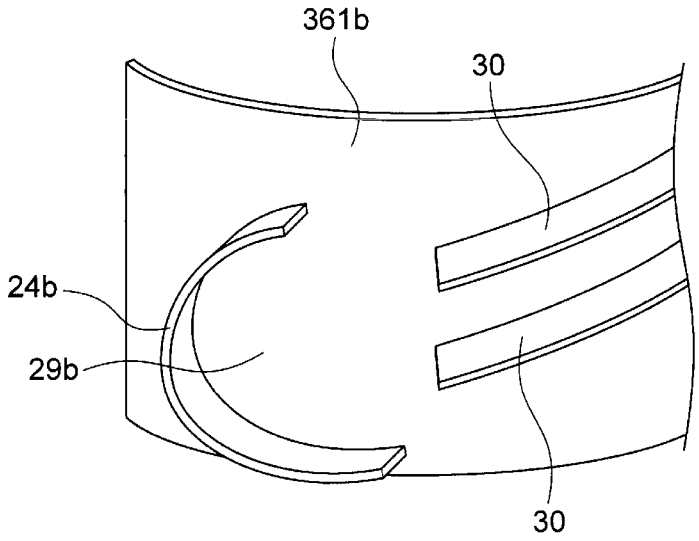
FIG. 30 is a schematic view illustrating a form example of a coolant flow suppressing wall.
Figure 31:
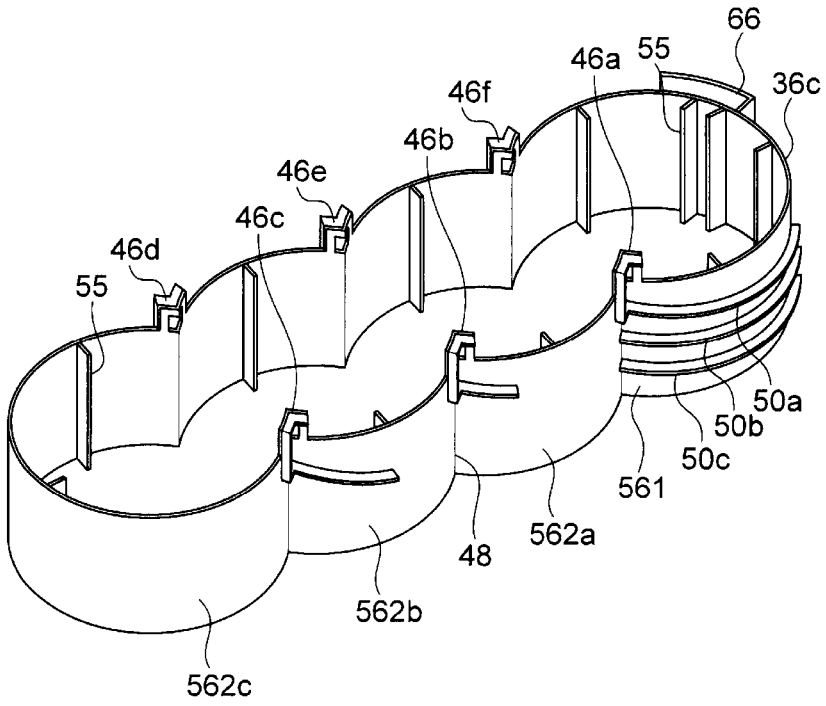
FIG. 31 is a schematic perspective view illustrating another form example of a water jacket spacer of the present invention.
Figure 32:
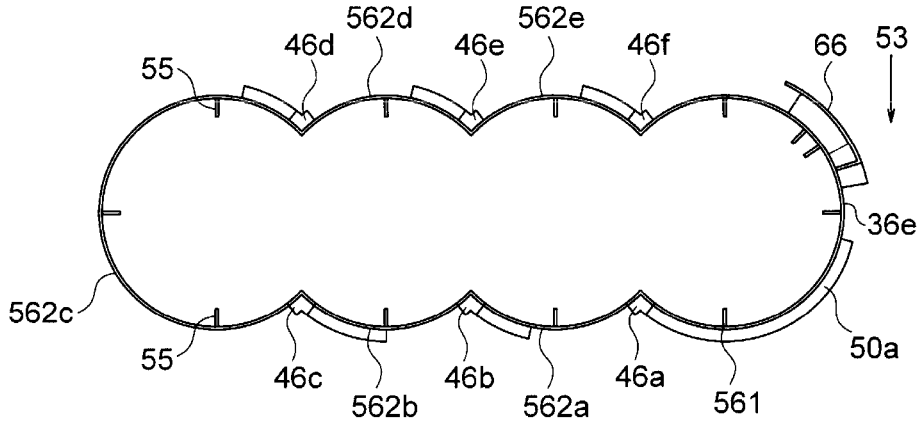
FIG. 32 is a plan view illustrating a water jacket spacer illustrated in FIG. 31, as viewed from the top.
Figure 33:
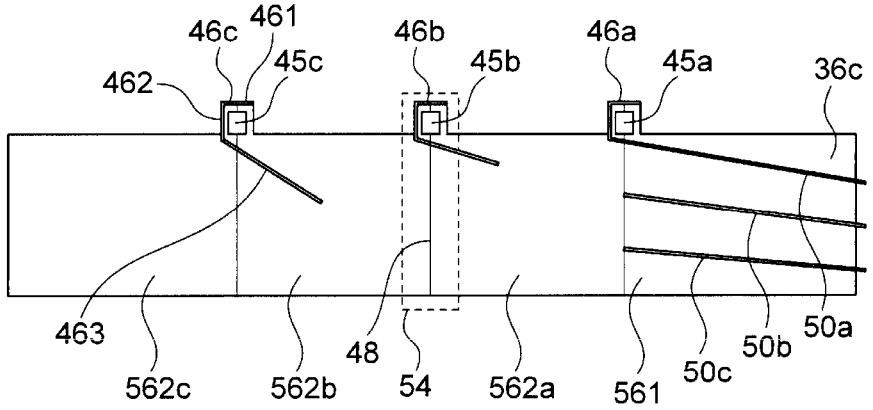
FIG. 33 is a side view illustrating a side on which an inclined wall of a water jacket spacer illustrated in FIG. 31 is formed, as viewed from a rear surface side.
Figure 34:
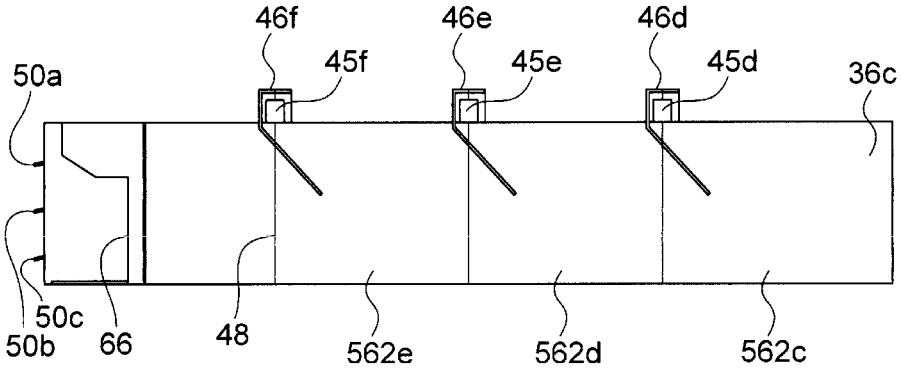
FIG. 34 is a side view illustrating a side on which an inclined wall of a water jacket spacer illustrated in FIG. 31 is not formed, as viewed from a rear surface side.

The coolant flow suppressing wall related to the water jacket spacer of the first (A) form of the present invention is a wall which is provided such that the coolant which has struck on the coolant contact surface flows toward the inclined wall without flowing in the opposite direction of the coolant flow direction. Therefore, the coolant flow suppressing wall is formed to surround a portion on the opposite side of the coolant flow direction in the coolant contact surface. That is, the wall is formed at the upper side, the lateral side, and the lower side of the portion of the coolant contact surface on the opposite side of the side toward which the coolant flows. In the form example illustrated in FIG. 5, a lateral side portion 241 of the coolant flow suppressing wall is formed on the entire lateral side on the opposite side of the side toward which the coolant flows, of the coolant contact surface, a lower side portion 242 of the coolant flow suppressing wall is formed on the entire lower side of the coolant contact surface, and an upper side portion 243 of the coolant flow suppressing wall is formed on an approximately half portion of the upper side of the coolant contact surface. However, the present invention is not limited to this form. A range surrounded by the coolant flow suppressing wall on the opposite side of the side toward which the coolant flows, of the coolant contact surface is selected as appropriate in a range in which the effects of the present invention are achieved. In the form example illustrated in FIG. 5, all of wall portions of the coolant flow suppressing wall are linear in a shape when viewed from a side, but the shape of the wall portion is not limited to this shape. For example, in the form example illustrated in FIG. 30, a curved coolant flow suppressing wall 24*b* which is formed in a substantially C shape when viewed from a side is formed on the opposite side of the side toward which the coolant flows, of a coolant contact surface 29*b*.

The coolant flow suppressing wall is a portion for preventing the coolant supplied into the groove-like coolant passage from immediately flowing to the coolant discharge port present in the vicinity of the coolant supply port.

In the water jacket spacer of the first (A) form of the present invention, the inclined wall is a wall for creating the flow of the coolant from the coolant contact surface toward a coolant passage opening such that the coolant flowing in the coolant flow direction flows toward the coolant passage opening after striking on the coolant contact surface. Therefore, the inclined wall extends with an upward inclination from the vicinity of the coolant contact surface as a start point. The number of inclined walls is selected as appropriate according to the number of coolant passage opening formed in the water jacket spacer. An inclination angle of the inclined wall is selected as appropriate by the position of the coolant passage opening formed in the water jacket spacer. The end point of the inclined wall is selected as appropriate in a range in which the effects of the present invention are achieved. In the form example illustrated in FIG. 5, the inclined walls 30*a* and 30*b* extend to the vicinity of the inter-bore portion, and the inclined wall 30*a* is connected to the lower end of the guide wall 26*a*. The inclined wall may or need not be connected to the guide wall. Note that in the present invention, the upward inclination means that when the coolant advances in the flow direction, the position becomes correspondingly high.

A water jacket spacer of the first (B) form of the present invention is a thermal insulator for a cylinder bore wall set in a cylinder block in which a part of the coolant supplied from the coolant supply port strikes on the water jacket spacer, in which the inclination of the rear surface side of the water jacket spacer with respect to the direction in which the coolant flows into the groove-like coolant passage is relatively small at a position where a part of the coolant supplied from the coolant supply port strikes on the water jacket spacer. In the cylinder block in which the water jacket spacer of the first (B) form of the present invention, a part of the coolant supplied from the coolant supply port strikes on the rear surface side of the water jacket spacer, but does not strongly strike thereon. In addition, much of the coolant supplied from the coolant supply port flows to pass through an area between the water jacket spacer and the wall surface on the opposite side of the wall surface on the cylinder bore side of the groove-like coolant passage.

The inclined wall related to the water jacket spacer of the first (B) form of the present invention extends with an upward inclination from, as a start point, the vicinity of a position of the water jacket spacer on which the coolant flowing from the coolant supply port firstly strikes. In the form example illustrated in FIG. 28, the coolant supply port 35 is provided at the position illustrated in FIG. 28, but the position of the coolant supply port varies depending on the type of internal combustion engine. Therefore, the position of the start point of the inclined wall is selected as appropriate according to the formation position of the coolant supply port of the cylinder block in which the water jacket spacer of the present invention is set.

In the water jacket spacer of the first (B) form of the present invention, the inclined wall is a wall for creating the flow of the coolant from the vicinity of the position where the coolant firstly strikes on the water jacket spacer toward the coolant passage opening so that the coolant flowing from the coolant supply opening flows toward the coolant passage opening. The inclined wall extends with an upward inclination from, as a start point, the vicinity of the position where the coolant flowing from the coolant supply opening firstly strikes on the water jacket spacer. The number of inclined walls is selected as appropriate according to the number of coolant passage opening formed in the water jacket spacer. An inclination angle of the inclined wall is selected as appropriate by the position of the coolant passage opening formed in the water jacket spacer. The end point of the inclined wall is selected as appropriate in a range in which the effects of the present invention are achieved. In the form example illustrated in FIG. 20, the inclined walls 50*a*, 50*b*, and 50*c* extend to the vicinity of the inter-bore portion, and the inclined wall 50*a* is connected to the lower end of the guide wall 46*a*. The inclined wall may or need not be connected to the guide wall.

Figure 29:
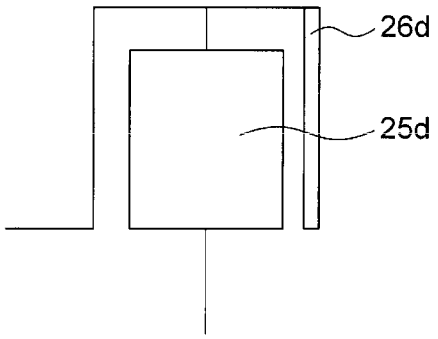
FIG. 29 is a schematic view illustrating a form example of a guide wall.
Figure 29:
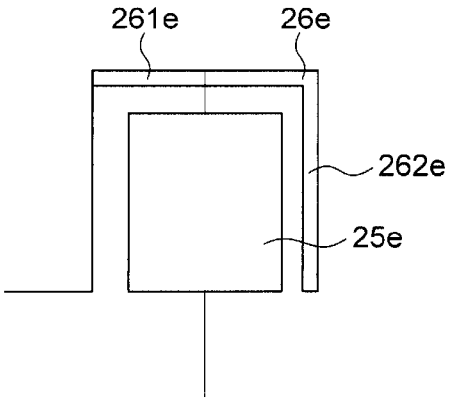
Figure 29:
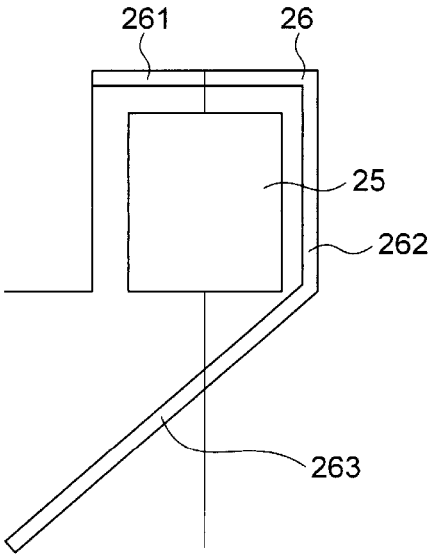

In the water jacket spacer of the first (A) form and the first (B) form of the present invention, a coolant passage opening is formed on an upper portion of an inter-bore portion. The coolant passage opening is a passage opening through which the coolant flowing on the rear surface side of the water jacket spacer passes to flow to the inner side of the water jacket spacer. The guide wall is formed in the vicinity of the coolant passage opening. The guide wall is a wall for guiding the coolant such that the coolant flowing from the coolant contact surface toward the coolant passage opening flows into the coolant passage opening. Since the coolant flows from the obliquely lower side toward the coolant passage opening, when the guide wall is formed on the lateral side in the coolant flow direction of the coolant passage opening similarly to the guide wall 26*d* illustrated in FIG. 29(A), the coolant flowing toward the coolant passage opening can be blocked by the guide wall formed on the lateral side in the coolant flow direction of the coolant passage opening. Therefore, the coolant can flow into the coolant passage opening 25. Accordingly, the guide wall has a wall at least on the lateral side in the coolant flow direction. As a form example of the guide wall, the guide wall includes a guide wall upper side portion 261*e* formed on the upper side of the coolant passage opening and a guide wall side portion 262*e* formed on the lateral side in the coolant flow direction similarly to the guide wall 26*e* illustrated in FIG. 29(B). Since the coolant flows from the obliquely lower side toward the coolant passage opening, the effect of feeding the coolant to the coolant passage opening is increased by providing the guide wall upper side portion on the upper side of the coolant passage opening in addition to the guide wall side portion formed on the lateral side in the flow direction of the coolant passage opening. Here, forming the guide wall on the upper side in addition to the guide wall on the lateral side of the coolant passage opening leads to large pressure loss of the coolant. Therefore, in the water jacket spacer of the present invention, whether the guide wall is formed only on the lateral side in the flow direction of the coolant passage opening or the guide walls are formed on both of the lateral side in the flow direction and the upper side of the coolant passage opening is selected as appropriate. That is, in the case of placing importance on prevention of increase in pressure loss, the guide wall is formed only on the lateral side in the flow direction of the coolant passage opening. In the case of placing more importance on cooling efficiency than on prevention of increase in pressure loss, the guide walls are formed on both of the lateral side in the flow direction and the upper side of the coolant passage opening. Some coolant flowing from the coolant contact surface toward the coolant passage opening flows slightly below the coolant passage opening. As illustrated in FIG. 29(C), the coolant gathering wall 263 extending with an upward inclination toward the lower end of the wall of the guide wall side portion 262 on the lateral side in the coolant flow direction of the coolant passage opening can be used to gather the coolant flowing slightly below the coolant passage opening and passing through the coolant passage opening at the coolant passage opening 25. Therefore, the guide wall that includes the coolant gathering wall extending with an upward inclination toward the lower end of the guide wall side portion in the coolant flow direction of the coolant passage opening is desirable in that the amount of the coolant flowing into the coolant passage opening can be increased. The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall. Note that the presence and absence of the coolant gathering wall is selected as appropriate according to the use purpose or the like of the spacer.

When the coolant is supplied to the groove-like coolant passage in a state in which the water jacket spacer of the first form of the present invention is set in the groove-like coolant passage of the cylinder lock, the coolant supplied to the groove-like coolant passage flows toward the coolant passage opening by the inclined wall formed on the rear surface side of the bore portion at a position where the coolant is supplied into the groove-like coolant passage, the coolant passage opening formed on the upper portion of the inter-bore portion, and the guide wall formed in the vicinity of the coolant passage opening, flows into the coolant passage opening, further passes through the coolant passage opening, and strikes on the upper portion of the boundary of the bore walls of the cylinder bores and the vicinity of the boundary. The coolant flowing on the rear surface side of the water jacket spacer from the coolant supply port and flowing toward the coolant passage opening has a low temperature, and the temperature of the upper portion of the boundary of the bore walls of the cylinder bores and the vicinity of the boundary is the highest in the wall surface on the cylinder bore side of the groove-like coolant passage. Accordingly, in the water jacket spacer of a first form of the present invention, the coolant having a low temperature that has flowed from the coolant supply port toward the coolant passage opening can strike on the highest temperature portion in the wall surface on the cylinder bore side of the groove-like coolant passage, whereby the cooling efficiency can be increased. In particular, in the case in which the passage hole of the coolant is formed in the inter-bore wall called a drill path, the opening of the drill path is provided on the upper portion of the boundary of the bore walls of the cylinder bores and the vicinity of the boundary. In that case, the coolant having a low temperature strikes on the upper portion of the boundary of bore walls of the cylinder bore walls and the vicinity of the boundary, this upper portion can be cooled and the coolant can flow in the drill path efficiently, whereby the inter-bore wall can be directly cooled with the coolant having a low temperature. Therefore, the cooling efficiency can be increased.

A water jacket spacer of a second form of the present invention is a water jacket spacer set in a groove-like coolant passage of a cylinder block of an internal combustion engine including cylinder bores and set in an entire circumferential direction or a part in a circumferential direction of the groove-like coolant passage when viewed in the circumferential direction, in which, a coolant passage opening through which coolant flowing on the rear surface side of the water jacket spacer passes to flow to an inner side of the water jacket spacer is formed on at least one place of upper portions of inter-bore portions, and a guide wall for guiding the coolant is formed in a vicinity of the coolant passage opening, such that the coolant flows into the coolant passage opening, and a coolant gathering wall is formed to extend with an upward inclination toward the guide wall.

The water jacket spacer of the second form of the present invention is set in the groove-like coolant passage of the cylinder block of the internal combustion engine. The cylinder block in which the water jacket spacer of the second form of the present invention is set is a cylinder block of an open deck type in which two or more cylinder bores are formed side by side in series, similarly to the cylinder block in which the water jacket spacer of the first form of the present invention is set.

A position where the water jacket spacer of the second form of the present invention is set is the same as that where the water jacket spacer of the first form of the present invention. The water jacket spacer of the second form of the present invention is desirably set in a middle and lower part of the groove-like coolant passage when in the structure of the internal combustion engine in which the spacer is set, a position equivalent to the middle and lower part of the groove-like coolant passage of the cylinder bore is a position where the speed of a piston increases. When in the structure of the internal combustion engine in which the spacer is set, a position corresponding to a lower part of the groove-like coolant passage of the cylinder bore is a position where the speed of a piston increases, the spacer is desirably set in the lower part of the groove-like coolant passage.

The water jacket spacer of the second form of the present invention is set in the entire circumferential direction or a part in a circumferential direction of the groove-like coolant passage when viewed in the circumferential direction. Examples of the water jacket spacer of the second form of the present invention include a water jacket spacer set in all of the entire groove-like coolant passage and a water jacket spacer set in a one-side half of the entire groove-like coolant passage. Examples of the water jacket spacer of the second form of the present invention include a water jacket spacer set in one one-side half and the other one-side half following the one one-side half of the entire groove-like coolant passage.

The water jacket spacer of the second form of the present invention is formed in a shape of a plurality of continuous arcs when viewed from above, and has a shape conforming to the groove-like coolant passage in which the water jacket spacer of the present invention is set.

The water jacket spacer of the second form of the present invention is an injection molded product made of a synthetic resin, for example. That is, the water jacket spacer of the second form of the present invention is made of a synthetic resin, for example. The synthetic resin of which the water jacket spacer of the second form of the present invention is made is not limited to a particular synthetic resin if the synthetic resin has heat resistance and LLC (long life coolant) resistance enough to allow use for the water jacket spacer set in the groove-like coolant passage of the cylinder block of the internal combustion engine, similarly to the water jacket spacer of the first form of the present invention.

None of the water jacket spacer of the second form of the present invention has inclined wall formed.

In the water jacket spacer of the second form of the present invention, a coolant passage opening is formed on an upper portion of an inter-bore portion. The coolant passage opening is a passage opening through which the coolant flowing on the rear surface side of the water jacket spacer passes to flow to the inner side of the supporting section. The guide wall is formed in the vicinity of the coolant passage opening, to guide the coolant such that the coolant flowing toward the coolant passage opening flows into the coolant passage opening. In the water jacket spacer of the second form of the present invention, the guide wall includes an upper wall formed on the upper side of the coolant passage opening and a side wall formed on the lateral side in the coolant flow direction of the coolant passage opening. The water jacket spacer of the second form of the present invention is set in the groove-like coolant passage in the one-side half on the opposite side of a side where the coolant that has flowed into the groove-like coolant passage vigorously flows. Therefore, the coolant slowly flows on the rear surface side of the supporting section of the water jacket spacer of the second form of the present invention. When a passage hole of the coolant called a drill path is provided in the cylinder block, the passage hole passing from the upper portion of the boundary of the bore walls of the cylinder bores to the inter-bore wall of the cylinder head, the gentle flow of the coolant toward the upper portion of the boundary of bore walls of the cylinder bores, that is, the coolant passage opening formed on the upper portion of the inter-bore portion is created in the groove-like coolant passage on the rear surface side of the supporting section of the water jacket spacer of the second form of the present invention. In the water jacket spacer of the second form of the present invention, the coolant gathering wall extending in an upward inclination toward the side wall of the guide wall is formed. The coolant flowing below the coolant passage opening is gathered, toward the coolant passage opening, together with the coolant flowing toward the coolant passage opening by the coolant gathering wall, and flows into the coolant passage opening by the guide wall. Accordingly, in the water jacket spacer of the second form of the present invention, the coolant flowing on the rear surface side can be gathered to flow into an inlet of the drill path, whereby the cooling efficiency can be increased. The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall.

In the form example illustrated in FIG. 13 and FIG. 14, the water jacket spacer of the first form of the present invention is set in one one-side half of the groove-like coolant passage of the cylinder block and the water jacket spacer of the second form of the present invention is set in the other one-side half of the groove-like coolant passage, but the present invention is not limited to this form. Only the water jacket spacer of the first form of the present invention may be set in the groove-like coolant passage of the cylinder block. Alternatively, only the water jacket spacer of the second form of the present invention may be set in the groove-like coolant passage of the cylinder block. Alternatively, the water jacket spacer of the first form of the present invention and the water jacket spacer of the second form of the present invention may be set in one one-side half and the other one-side half of the groove-like coolant passage, respectively. Alternatively, the water jacket spacer of the first form of the present invention and a water jacket spacer other than the water jacket spacer of the present invention or a thermal insulator for a cylinder bore wall may be set in one one-side half and the other one-side half of the groove-like coolant passage, respectively. Alternatively, the water jacket spacer of the second form of the present invention and a water jacket spacer other than the water jacket spacer of the present invention or a thermal insulator for a cylinder bore wall may be set in one one-side half and the other one-side half of the groove-like coolant passage, respectively. Alternatively, a water jacket spacer in a form in which the water jacket spacer of the first form of the present invention and the water jacket spacer of the second form of the present invention are combined (described later) may be set in the groove-like coolant passage.

As the water jacket spacer of the first form of the present invention and the water jacket spacer of the second form of the present invention, when viewed in the circumferential direction, the shape of the supporting section is a shape conforming to the entire circumference of the groove-like coolant passage, and a water jacket spacer is provided by combining the water jacket spacer of the first form of the present invention and the water jacket spacer of the second form of the present invention. In a water jacket spacer 36*c* of a form example illustrated in FIG. 31 to FIG. 34, the shape of the supporting section is a shape conforming to the entire circumference of the groove-like coolant passage. In addition, the inclined walls are formed in the bore portion 561 at a position where the coolant is supplied into the groove-like coolant passage, the coolant passage openings 45*a*, 45*b*, and 45*c* and the guide walls 46*a*, 46*b*, and 46*c* are formed on the upper portions of the inter-bore portions that are set in the groove-like coolant passage in one one-side half in which the coolant flows more vigorously than in the other one-side half, and the coolant gathering wall 463 is formed as needed. In addition, the coolant passage openings

46*d*, 46*e*, and 46*f*, the guide wall including the upper wall formed on the upper side of the coolant passage opening and the side wall on the lateral side in the coolant flow direction of the coolant passage opening, and the coolant gathering wall are formed on the upper portion of the inter-bore portions set in the groove-like coolant passage in the one-side half on the opposite side of a side where the coolant vigorously flows. The coolant flow changing member 66 is formed in front of the coolant supply port of the groove-like coolant passage in the one-side half on the opposite side of a side where the coolant vigorously flows.

As a form in which the water jacket spacer of the first form of the present invention and the water jacket spacer of the second form of the present invention are combined, that is, a water jacket spacer having a shape conforming to the entire circumference of the groove-like coolant passage, and having a feature of the water jacket spacer of the first form of the present invention in one one-side half of the groove-like coolant passage and a feature of the water jacket spacer of the second form of the present invention in the other one-side half of the groove-like coolant passage is a water jacket spacer set in the groove-like coolant passage of a cylinder block of an internal combustion engine including cylinder bores and set in an entire circumferential direction of the groove-like coolant passage when viewed in the circumferential direction, in which an inclined wall is formed at a position where coolant is supplied into the groove-like coolant passage, a coolant passage opening through which coolant flowing on a rear surface side of the water jacket spacer passes to flow to an inner side of the water jacket spacer is formed on at least one place of upper portions of inter-bore portions set in the groove-like coolant passage in one-side half in which the coolant flows more vigorously, a guide wall (having at least a side wall on a lateral side in a coolant flow direction, and an upper wall as needed) for guiding the coolant is formed in a vicinity of the coolant passage opening such that the coolant flows into the coolant passage opening, and a coolant gathering wall is further formed to extend with an upward inclination toward the guide wall as needed, and a coolant passage opening through which coolant flowing on a rear surface side of the water jacket spacer passes to flow to the inner side of the water jacket spacer is formed on at least one place of the upper portions of inter-bore portions set in the groove-like coolant passage in one-side half on an opposite side of a side on which the coolant flows more vigorously, a guide wall (having an upper wall and a side wall on a lateral side in a coolant flow direction) for guiding the coolant is formed in the vicinity of the coolant passage opening such that the coolant flows into the coolant passage opening, and a coolant gathering wall is formed to extend with an upward inclination toward the guide wall.

The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall.

The water jacket spacers of the first form and the second form of the present invention may include a horizontal rib formed on the upper portion on the rear surface side of the supporting section, the horizontal rib extending in parallel to the coolant flow direction. The water jacket spacers of the first form and the second form of the present invention include the horizontal rib formed on the upper portion on the rear surface side, the horizontal rib extending in parallel to the coolant flow direction, whereby the coolant flowing on the upper portion of the groove-like coolant passage can be prevented from flowing down into a middle and lower part. A formation position in the up-down direction of the horizontal rib extending in parallel to the coolant flow direction, the horizontal rib being formed on the upper portion on the rear surface side, and the formation position and length in the coolant flow direction of the horizontal rib are selected as appropriate.

The water jacket spacers of the first form and the second form of the present invention may include a cylinder head contact portion formed in the supporting section to prevent the water jacket spacer from deviating in the upward direction, the other parts or member.

An internal combustion engine of the present invention is an internal combustion engine in which at least one of the water jacket spacer of the first form of the present invention, the water jacket spacer of the second form of the present invention, and the water jacket spacer in a form in which the water jacket spacer of the first form of the present invention and the water jacket spacer of the second form of the present invention are combined is set in the entire or a part of the groove-like coolant passage of the cylinder block.

The internal combustion engine of the present invention is an internal combustion engine in which the water jacket spacer of the first form is set in one one-side half of the groove-like coolant passage of the cylinder block and the water jacket spacer of the second form is set in the other one-side half of the groove-like coolant passage of the cylinder block.

In the internal combustion engine of the present invention, the water jacket spacer of the first form of the present invention or the water jacket spacer of the second form of the present invention is set in the entire or a part of the groove-like coolant passage of the cylinder block. A water jacket spacer other than the water jacket spacer of the present invention or a thermal insulator for a cylinder bore wall may be set in the groove-like coolant passage in which the water jacket spacer of the first form of the present invention or the water jacket spacer of the second form of the present invention is not formed.

An automobile of the present invention is an automobile including the internal combustion engine of the present invention.

INDUSTRIAL APPLICABILITY

According to the present invention, since the coolant having a low temperature can strike on the upper portion of the boundary of the bore walls of the cylinder bore walls and the vicinity of the boundary, whereby the cooling efficiency can be increased. Particularly, it is possible to increase the cooling efficiency of an internal combustion engine with a large air-fuel ratio, the temperature of which being higher than that of the conventional internal combustion engine.

REFERENCE SIGNS LIST

6, 6*c* Contact surface
8 Bottom part
9 Top part
10 Position near middle
11, 31 Cylinder block
12 Bore
12*a*1, 12*a*2 End bore
12*b*1, 12*b*2 Intermediate bore
13 Cylinder bore wall
14 Groove-like coolant passage

14*a*, 14*b* Groove-like coolant passage in one-side half
15, 35 Coolant supply port
16 Coolant discharge port
17 Wall surface on cylinder bore side of groove-like coolant passage 14
18 Wall surface on opposite side of wall surface on cylinder bore side of groove-like coolant passage 14
20*a*, 20*b* One-side half
21*a*, 21*b* Bore wall in one-side half
23*a*1, 23*a*2, 23*b*1, 23*b*2 Bore wall of cylinder bore
24, 24*b* Coolant flow suppressing wall
25, 25*a*, 25*b*, 25*c*, 25*d*, 25*e*, 25*f*, 25*g*, 25*h*, 45*a*, 45*b*, 45*c*, 45*d*, 45*e*, 45*f* Coolant passage opening
26, 26*a*, 26*b*, 26*c*, 26*d*, 26*e*, 46*a*, 46*b*, 46*c*, 46*d*, 46*e*, 46*d*, 126*a*, 126*b*, 126*c* Guide wall
29, 29*b* Coolant contact surface
30, 30*a*, 30*b*, 50*a*, 50*b*, 50*c* Inclined wall
34. 55
36*a*, 36*b*, 36*c*, 136*a* Water jacket spacer
37, 40, 41, 40*d* Bending section
39, 39*a* Metal leaf spring
42 Opening
43 Metal plate
45 Punched product of metal plate
48 Boundary of supporting section bore portions
51 Coolant flow direction
52 Opposite direction of coolant flow direction
53 Coolant
54 Inter-bore portion of water jacket spacer
66 Coolant flow changing member
131 Inter-bore wall
192 Boundary of bore walls of cylinder bores of wall surface on cylinder bore side of groove-like coolant passage
241 Lateral side portion of coolant flow suppressing wall
242 Lower side portion of coolant flow suppressing wall
243 Upper side portion of coolant flow suppressing wall
261, 261*e* Upper side portion of guide wall
262, 262*e* Lateral side portion of guide wall
263 Coolant gathering wall of guide wall
361, 361*b*, 561 Supporting section bore portion in which inclined wall is formed
362, 362*a*, 362*b*, 362*c*, 363*a*, 363*b*, 363*c*, 363*d*, 562, 562*a*, 562*b*, 562*c*, 562*d*, 562*e* Bore portion in which inclined wall is not formed
661 Coolant flow changing wall
662 Enclosure wall

The invention claimed is:

1. A water jacket spacer set in a groove-like coolant passage of a cylinder block of an internal combustion engine including cylinder bores and set in an entire circumferential direction or a part in a circumferential direction of the groove-like coolant passage when viewed in the circumferential direction, the groove-like coolant passage has a first wall surface on the cylinder bore side and a second wall surface on the side opposite to the first wall surface, wherein a coolant passage opening through which coolant flowing on a rear surface side of the water jacket spacer passes to flow to an inner side of the water jacket spacer is formed on at least one place of upper portions of inter-bore portions, a guide wall for guiding the coolant is formed in a vicinity of the coolant passage opening and projected from the rear surface toward the second wall surface, such that the coolant flows into the coolant passage opening; and an inclined wall projected from the rear surface of a position where the coolant is supplied into the groove-like coolant passage toward the second wall surface, the inclined wall is continuous with the guide wall and extending with an upward inclination to create a flow of the coolant toward the coolant passage opening.

2. A water jacket spacer set in a groove-like coolant passage of a cylinder block of an internal combustion engine including cylinder bores and set in an entire circumferential direction or a part in a circumferential direction of the groove-like coolant passage when viewed in the circumferential direction, the groove-like coolant passage has a first wall surface on the cylinder bore side and a second wall surface on the side opposite to the first wall surface, wherein, a coolant passage opening through which coolant flowing on the rear surface side of the water jacket spacer passes to flow to an inner side of the water jacket spacer is formed on at least one place of upper portions of inter-bore portions, and a guide wall for guiding the coolant is formed in a vicinity of the coolant passage opening and projected from the rear surface toward the second wall surface, such that the coolant flows into the coolant passage opening, and a coolant gathering wall projected from the rear surface toward the second wall surface and is formed to be continuous with the guide wall and extend with an upward inclination toward the guide wall.

3. A water jacket spacer set in a groove-like coolant passage of a cylinder block of an internal combustion engine including cylinder bores and set in an entire circumferential direction of the groove-like coolant passage when viewed in the circumferential direction, the groove-like coolant passage has a first wall surface on the cylinder bore side and a second wall surface on the side opposite to the first wall surface, wherein, an inclined wall is formed at a position where coolant is supplied into the groove-like coolant passage, a coolant passage opening through which coolant flowing on a rear surface side of the water jacket spacer passes to flow to an inner side of the water jacket spacer is formed on at least one place of upper portions of inter-bore portions set in the groove-like coolant passage in one-side half in which the coolant flows more vigorously, and a guide wall for guiding the coolant is formed in a vicinity of the coolant passage opening and projected from the rear surface toward the second wall surface, such that the coolant flows into the coolant passage opening, and a coolant passage opening through which coolant flowing on a rear surface side of the water jacket spacer passes to flow to the inner side of the water jacket spacer is formed on at least one place of the upper portions of inter-bore portions set in the groove-like coolant passage in one-side half on an opposite side of a side on which the coolant flows more vigorously, a guide wall for guiding the coolant is formed in the vicinity of the coolant passage opening and projected from the rear surface toward the second wall surface, such that the coolant flows into the coolant passage opening, and a coolant gathering wall projected from the rear surface toward the second wall surface and is formed to be continuous with the guide wall and extend with an upward inclination toward the guide wall.

* * * * *